US010859353B1

(12) United States Patent
Minica

(10) Patent No.: US 10,859,353 B1
(45) Date of Patent: Dec. 8, 2020

(54) LIGHTED NOCK DEVICE

(71) Applicant: Stuart Minica, La Vernia, TX (US)

(72) Inventor: Stuart Minica, La Vernia, TX (US)

( * ) Notice: Subject to any disclaimer, the term of this patent is extended or adjusted under 35 U.S.C. 154(b) by 0 days.

(21) Appl. No.: 16/258,273

(22) Filed: Jan. 25, 2019

Related U.S. Application Data

(60) Provisional application No. 62/622,688, filed on Jan. 26, 2018.

(51) Int. Cl.
*F42B 6/06* (2006.01)

(52) U.S. Cl.
CPC ..... *F42B 6/06* (2013.01)

(58) Field of Classification Search
CPC ..... F42B 6/06; F42B 12/38; F42B 12/382; F42B 12/42
USPC ..... 473/578
See application file for complete search history.

(56) References Cited

U.S. PATENT DOCUMENTS 4,547,837 A * 10/1985 Bennett ..... F42B 6/06 200/60
5,134,552 A * 7/1992 Call ..... F21L 15/00 362/109
6,123,631 A * 9/2000 Ginder ..... F42B 6/06 473/570
6,364,499 B1 * 4/2002 Jones ..... F21K 2/06 124/91
6,736,742 B2 * 5/2004 Price ..... F42B 6/06 473/570
7,021,784 B2 * 4/2006 DiCarlo ..... F21V 33/008 362/109
7,837,580 B2 * 11/2010 Huang ..... F42B 12/38 473/570
8,342,990 B1 * 1/2013 Price ..... F42B 6/06 473/586
8,540,594 B2 * 9/2013 Chu ..... F42B 6/06 473/586
8,758,177 B2 * 6/2014 Minica ..... F42B 6/06 473/586
8,777,786 B1 * 7/2014 Bay ..... F42B 12/42 473/578
9,028,347 B2 * 5/2015 Pedersen ..... F21V 33/008 473/578
9,151,580 B2 * 10/2015 Pedersen ..... F42B 6/06
9,329,005 B2 * 5/2016 Meier ..... F42B 12/365
9,546,851 B2 * 1/2017 Kim ..... F42B 12/382
9,677,859 B1 * 6/2017 Kim ..... F42B 6/06
9,702,672 B1 * 7/2017 Kim ..... F42B 6/06
9,897,423 B2 * 2/2018 Bay ..... F42B 6/06
10,001,353 B1 * 6/2018 Godsey ..... F42B 6/06
10,203,187 B1 * 2/2019 Bay ..... F42B 12/42
10,254,095 B1 * 4/2019 Wang ..... F21S 9/02
(Continued)

*Primary Examiner* — Alexander R Niconovich
(74) *Attorney, Agent, or Firm* — Taboada Law Firm, PLLC; John M. Taboada

(57) ABSTRACT

Methods and systems for illuminating an arrow nock or bolt end are disclosed, including providing a nock having a nock body comprising an arrow or shaft attachment portion and a slot adapted to receive a bowstring; and a luminous assembly at least partially disposed within the nock body, wherein the luminous assembly comprises a power source, a light source, and a switch, and alternately activated or deactivated by depressing and releasing of the light source. Other embodiments are described and claimed.

19 Claims, 19 Drawing Sheets

(56) References Cited

U.S. PATENT DOCUMENTS

| | | | | |
|---|---|---|---|---|
| 2012/0100942 | A1* | 4/2012 | Minica | F42B 6/06 473/570 |
| 2014/0148282 | A1* | 5/2014 | Marshall, Jr. | F42B 6/06 473/570 |
| 2016/0202029 | A1* | 7/2016 | Pedersen | F42B 12/382 473/570 |
| 2018/0231356 | A1* | 8/2018 | Yehle | F42B 12/42 |
| 2019/0265009 | A1* | 8/2019 | Harrington | F42B 6/06 |

* cited by examiner

LIGHTED NOCK DEVICE

I. CROSS REFERENCE TO RELATED APPLICATIONS

This application claims the benefit of the filing date of U.S. Provisional Patent Application Ser. No. 62/622,688, filed on Jan. 26, 2018, entitled "Lighted Nock Device," the entire disclosure of which is hereby incorporated by reference into the present disclosure.

II. BACKGROUND

The invention relates generally to the field of archery and the problem of being able to see an arrow in flight, being able to see the point of arrow impact, and most importantly, finding an arrow after the shot. More specifically, this invention relates to an improved luminous assembly which is toggled on and off by the direct or indirect depressing and releasing of an integrated switch.

III. SUMMARY

In one respect, disclosed is a lighted nock comprising: a nock body comprising: an arrow or shaft attachment portion; and a slot adapted to receive a bowstring; and a luminous assembly at least partially disposed within the nock body, wherein the luminous assembly comprises a power source, a light source, and a switch; wherein the luminous assembly is configured to alternately activate or deactivate in response to depressing and releasing of the switch.

In another respect, disclosed is a lighted nock comprising: a nock body comprising: an arrow or shaft attachment portion; and a slot adapted to receive a bowstring; and a luminous assembly at least partially disposed within the nock body, wherein the luminous assembly comprises a power source, a light source, and a switch; wherein the luminous assembly is configured to alternately activate or deactivate in response to depressing and releasing of the switch; and wherein the luminous assembly is activated when the bowstring is withdrawn from the slot and the switch is closed.

In another respect, disclosed is a lighted nock comprising: a nock body comprising: an arrow or shaft attachment portion; and a slot adapted to receive a bowstring; and a luminous assembly at least partially disposed within the nock body, wherein the luminous assembly comprises a power source, a light source, and a switch; wherein the luminous assembly is configured to alternately activate or deactivate in response to depressing and releasing of the switch; and wherein at least a portion of the switch protrudes through and into the slot when the luminous assembly is in either an activated or deactivated state.

In another respect, disclosed is a lighted nock comprising: a nock body comprising: an arrow or shaft attachment portion; and a slot adapted to receive a bowstring; and a luminous assembly at least partially disposed within the nock body, wherein the luminous assembly comprises a power source, a light source, and a switch; wherein the luminous assembly is configured to alternately activate or deactivate in response to depressing and releasing of the switch; and wherein the slot comprises: a bottom; and a middle portion; wherein the bottom is adapted to receive the bowstring and wherein the middle portion is configured to retain the bowstring in the bottom of the slot.

In another respect, disclosed is a lighted nock comprising: a nock body comprising: an arrow or shaft attachment portion; and a slot adapted to receive a bowstring; a luminous assembly at least partially disposed within the nock body, wherein the luminous assembly comprises a power source, a light source, and a switch; and an adapter comprising an inner diameter and an outer diameter, wherein the inner diameter is configured to mate with the arrow or shaft attachment portion of the nock body and wherein the outer diameter is configured to mate with an arrow or shaft; wherein the luminous assembly is configured to alternately activate or deactivate in response to depressing and releasing of the switch.

In yet another respect, disclosed is a lighted nock comprising: a nock body comprising: an arrow or shaft attachment portion; and a slot adapted to receive a bowstring; and a luminous assembly at least partially disposed within the nock body, wherein the luminous assembly comprises a power source, a light source, and a switch; wherein the luminous assembly is configured to alternately activate or deactivate in response to depressing and releasing of the light source.

In another respect, disclosed is a lighted nock comprising: a nock body comprising: an arrow or shaft attachment portion; and a slot adapted to receive a bowstring; and a luminous assembly at least partially disposed within the nock body, wherein the luminous assembly comprises a power source, a light source, and a switch; wherein the luminous assembly is configured to alternately activate or deactivate in response to depressing and releasing of the light source; and wherein the luminous assembly is activated when the bowstring is withdrawn from the slot and the switch is closed.

In another respect, disclosed is a lighted nock comprising: a nock body comprising: an arrow or shaft attachment portion; and a slot adapted to receive a bowstring; and a luminous assembly at least partially disposed within the nock body, wherein the luminous assembly comprises a power source, a light source, and a switch; wherein the luminous assembly is configured to alternately activate or deactivate in response to depressing and releasing of the light source; and wherein at least a portion of the light source protrudes through and into the slot when the luminous assembly is in either an activated or deactivated state.

In another respect, disclosed is a lighted nock comprising: a nock body comprising: an arrow or shaft attachment portion; and a slot adapted to receive a bowstring; and a luminous assembly at least partially disposed within the nock body, wherein the luminous assembly comprises a power source, a light source, and a switch; wherein the luminous assembly is configured to alternately activate or deactivate in response to depressing and releasing of the light source; and wherein the slot comprises: a bottom; and a middle portion; wherein the bottom is adapted to receive the bowstring and wherein the middle portion is configured to retain the bowstring in the bottom of the slot.

In another respect, disclosed is a lighted nock comprising: a nock body comprising: an arrow or shaft attachment portion; and a slot adapted to receive a bowstring; a luminous assembly at least partially disposed within the nock body, wherein the luminous assembly comprises a power source, a light source, and a switch; and an adapter comprising an inner diameter and an outer diameter, wherein the inner diameter is configured to mate with the arrow or shaft attachment portion of the nock body and wherein the outer diameter is configured to mate with an arrow or shaft; wherein the luminous assembly is configured to alternately activate or deactivate in response to depressing and releasing of the light source and In yet another respect, disclosed is a lighted nock comprising: a nock body comprising: an arrow or shaft attachment portion; and a slot adapted to receive a bowstring; a push member at least partially disposed within the nock body; and a luminous assembly at least partially disposed within the nock body, wherein the luminous assembly comprises a power source, a light source, and a switch; wherein the luminous assembly is configured to alternately activate or deactivate in response to depressing and releasing of the push member.

In another respect, disclosed is a lighted nock comprising: a nock body comprising: an arrow or shaft attachment portion; and a slot adapted to receive a bowstring; a push member at least partially disposed within the nock body; and a luminous assembly at least partially disposed within the nock body, wherein the luminous assembly comprises a power source, a light source, and a switch; wherein the luminous assembly is configured to alternately activate or deactivate in response to depressing and releasing of the push member; and wherein the luminous assembly is activated when the bowstring is withdrawn from the slot and the switch is closed.

In another respect, disclosed is a lighted nock comprising: a nock body comprising: an arrow or shaft attachment portion; and a slot adapted to receive a bowstring; a push member at least partially disposed within the nock body; and a luminous assembly at least partially disposed within the nock body, wherein the luminous assembly comprises a power source, a light source, and a switch; wherein the luminous assembly is configured to alternately activate or deactivate in response to depressing and releasing of the push member; and wherein at least a portion of the push member protrudes through and into the slot when the luminous assembly is in either an activated or deactivated state.

In another respect, disclosed is a lighted nock comprising: a nock body comprising: an arrow or shaft attachment portion; and a slot adapted to receive a bowstring; a push member at least partially disposed within the nock body; and a luminous assembly at least partially disposed within the nock body, wherein the luminous assembly comprises a power source, a light source, and a switch; wherein the luminous assembly is configured to alternately activate or deactivate in response to depressing and releasing of the push member and wherein the slot comprises: a bottom; and a middle portion; wherein the bottom is adapted to receive the bowstring and wherein the middle portion is configured to retain the bowstring in the bottom of the slot.

In another respect, disclosed is a lighted nock comprising: a nock body comprising: an arrow or shaft attachment portion; and a slot adapted to receive a bowstring; a push member at least partially disposed within the nock body; a luminous assembly at least partially disposed within the nock body, wherein the luminous assembly comprises a power source, a light source, and a switch; and an adapter comprising an inner diameter and an outer diameter, wherein the inner diameter is configured to mate with the arrow or shaft attachment portion of the nock body and wherein the outer diameter is configured to mate with an arrow or shaft; wherein the luminous assembly is configured to alternately activate or deactivate in response to depressing and releasing of the push member.

In yet another respect, disclosed is a lighted nock comprising: a nock body comprising: an arrow or shaft attachment portion; and a slot adapted to receive a bowstring; and a luminous assembly at least partially disposed within the nock body, wherein the luminous assembly comprises a power source, a light source, a push member, and a switch; wherein the luminous assembly is configured to alternately activate or deactivate in response to depressing and releasing of the push member.

In another respect, disclosed is a lighted nock comprising: a nock body comprising: an arrow or shaft attachment portion; and a slot adapted to receive a bowstring; and a luminous assembly at least partially disposed within the nock body, wherein the luminous assembly comprises a power source, a light source, a push member, and a switch; wherein the luminous assembly is configured to alternately activate or deactivate in response to depressing and releasing of the push member; and wherein the luminous assembly is activated when the bowstring is withdrawn from the slot and the switch is closed.

In another respect, disclosed is a lighted nock comprising: a nock body comprising: an arrow or shaft attachment portion; and a slot adapted to receive a bowstring; and a luminous assembly at least partially disposed within the nock body, wherein the luminous assembly comprises a power source, a light source, a push member, and a switch; wherein the luminous assembly is configured to alternately activate or deactivate in response to depressing and releasing of the push member; and wherein at least a portion of the push member protrudes through and into the slot when the luminous assembly is in either an activated or deactivated state.

In another respect, disclosed is a lighted nock comprising: a nock body comprising: an arrow or shaft attachment portion; and a slot adapted to receive a bowstring; and a luminous assembly at least partially disposed within the nock body, wherein the luminous assembly comprises a power source, a light source, a push member, and a switch; wherein the luminous assembly is configured to alternately activate or deactivate in response to depressing and releasing of the push member; and wherein the slot comprises: a bottom; and a middle portion; wherein the bottom is adapted to receive the bowstring and wherein the middle portion is configured to retain the bowstring in the bottom of the slot.

In another respect, disclosed is a lighted nock comprising: a nock body comprising: an arrow or shaft attachment portion; and a slot adapted to receive a bowstring; a luminous assembly at least partially disposed within the nock body, wherein the luminous assembly comprises a power source, a light source, a push member, and a switch; and an adapter comprising an inner diameter and an outer diameter, wherein the inner diameter is configured to mate with the arrow or shaft attachment portion of the nock body and wherein the outer diameter is configured to mate with an arrow or shaft; wherein the luminous assembly is configured to alternately activate or deactivate in response to depressing and releasing of the push member.

In yet another respect, disclosed is a luminous assembly comprising: a body; a power source at least partially disposed within the body; a light source at least partially disposed within the body; and a switch at least partially disposed within the body and wherein at least a portion of the switch protrudes through the body; wherein the switch operatively connects the light source and the power source; and wherein the luminous assembly is configured to alternately activate or deactivate in response to depressing and releasing the switch.

In another respect, disclosed is a luminous assembly comprising: a body; a power source at least partially disposed within the body; a light source at least partially disposed within the body; and a switch at least partially disposed within the body and wherein at least a portion of the switch protrudes through the body; wherein the switch operatively connects the light source and the power source; wherein the luminous assembly is configured to alternately activate or deactivate in response to depressing and releasing the switch; and wherein the body comprises a nock; and wherein the nock comprises an arrow or shaft attachment portion and a slot adapted to receive a bowstring.

In another respect, disclosed is a luminous assembly comprising: a body; a power source at least partially disposed within the body; a light source at least partially disposed within the body; and a switch at least partially disposed within the body and wherein at least a portion of the switch protrudes through the body; wherein the switch operatively connects the light source and the power source; wherein the luminous assembly is configured to alternately activate or deactivate in response to depressing and releasing the switch; wherein the body comprises a nock; wherein the nock comprises an arrow or shaft attachment portion and a slot adapted to receive a bowstring; and wherein the luminous assembly is activated when the bowstring is withdrawn from the slot and the switch is closed.

In another respect, disclosed is a luminous assembly comprising: a body; a power source at least partially disposed within the body; a light source at least partially disposed within the body; and a switch at least partially disposed within the body and wherein at least a portion of the switch protrudes through the body; wherein the switch operatively connects the light source and the power source; wherein the luminous assembly is configured to alternately activate or deactivate in response to depressing and releasing the switch; wherein the body comprises a nock; wherein the nock comprises an arrow or shaft attachment portion and a slot adapted to receive a bowstring; and wherein at least a portion of the switch protrudes through and into the slot when the luminous assembly is in either an activated or deactivated state.

In another respect, disclosed is a luminous assembly comprising: a body; a power source at least partially disposed within the body; a light source at least partially disposed within the body; and a switch at least partially disposed within the body and wherein at least a portion of the switch protrudes through the body; wherein the switch operatively connects the light source and the power source; wherein the luminous assembly is configured to alternately activate or deactivate in response to depressing and releasing the switch; wherein the body comprises a nock; wherein the nock comprises an arrow or shaft attachment portion and a slot adapted to receive a bowstring; and wherein the slot comprises: a bottom; and a middle portion; wherein the bottom is adapted to receive the bowstring and wherein the middle portion is configured to retain the bowstring in the bottom of the slot.

In another respect, disclosed is a luminous assembly comprising: a body; a power source at least partially disposed within the body; a light source at least partially disposed within the body; a switch at least partially disposed within the body and wherein at least a portion of the switch protrudes through the body; and an adapter comprising an inner diameter and an outer diameter, wherein the inner diameter is configured to mate with the arrow or shaft attachment portion of the nock and wherein the outer diameter is configured to mate with an arrow or shaft; wherein the switch operatively connects the light source and the power source; wherein the luminous assembly is configured to alternately activate or deactivate in response to depressing and releasing the switch; wherein the body comprises a nock; and wherein the nock comprises an arrow or shaft attachment portion and a slot adapted to receive a bowstring.

In another respect, disclosed is a luminous assembly comprising: a body; a power source at least partially disposed within the body; a light source at least partially disposed within the body; and a switch at least partially disposed within the body and wherein at least a portion of the switch protrudes through the body; wherein the switch operatively connects the light source and the power source; wherein the luminous assembly is configured to alternately activate or deactivate in response to depressing and releasing the switch; wherein the body comprises a bolt end; and wherein the bolt end comprises a bolt attachment portion and a proximate end adapted to abut against a bowstring.

In another respect, disclosed is a luminous assembly comprising: a body; a power source at least partially disposed within the body; a light source at least partially disposed within the body; and a switch at least partially disposed within the body and wherein at least a portion of the switch protrudes through the body; wherein the switch operatively connects the light source and the power source; wherein the luminous assembly is configured to alternately activate or deactivate in response to depressing and releasing the switch; wherein the body comprises a bolt end; wherein the bolt end comprises a bolt attachment portion and a proximate end adapted to abut against a bowstring; and wherein the luminous assembly is activated when the bolt end is separated from the bowstring and the switch is closed.

In another respect, disclosed is a luminous assembly comprising: a body; a power source at least partially disposed within the body; a light source at least partially disposed within the body; and a switch at least partially disposed within the body and wherein at least a portion of the switch protrudes through the body; wherein the switch operatively connects the light source and the power source; wherein the luminous assembly is configured to alternately activate or deactivate in response to depressing and releasing the switch; wherein the body comprises a bolt end; wherein the bolt end comprises a bolt attachment portion and a proximate end adapted to abut against a bowstring; and wherein at least a portion of the switch protrudes through the proximate end when the luminous assembly is in either an activated or deactivated state.

In another respect, disclosed is a luminous assembly comprising: a body; a power source at least partially disposed within the body; a light source at least partially disposed within the body; a switch at least partially disposed within the body and wherein at least a portion of the switch protrudes through the body; and an adapter comprising an inner diameter and an outer diameter, wherein the inner diameter is configured to mate with the bolt or shaft attachment portion of the bolt end and wherein the outer diameter is configured to mate with a bolt or shaft; wherein the switch operatively connects the light source and the power source; wherein the luminous assembly is configured to alternately activate or deactivate in response to depressing and releasing the switch; wherein the body comprises a bolt end; and wherein the bolt end comprises a bolt attachment portion and a proximate end adapted to abut against a bowstring.

In yet another respect, disclosed is a luminous assembly comprising: a body; a power source at least partially disposed within the body; a light source at least partially disposed within the body and wherein at least a portion of the light source protrudes through the body; and a switch at least partially disposed within the body; wherein the switch operatively connects the light source and the power source;

and wherein the luminous assembly is configured to alternately activate or deactivate in response to depressing and releasing the light source.

In another respect, disclosed is a luminous assembly comprising: a body; a power source at least partially disposed within the body; a light source at least partially disposed within the body and wherein at least a portion of the light source protrudes through the body; and a switch at least partially disposed within the body; wherein the switch operatively connects the light source and the power source; wherein the luminous assembly is configured to alternately activate or deactivate in response to depressing and releasing the light source; wherein the body comprises a nock; and wherein the nock comprises an arrow or shaft attachment portion and a slot adapted to receive a bowstring.

In another respect, disclosed is a luminous assembly comprising: a body; a power source at least partially disposed within the body; a light source at least partially disposed within the body and wherein at least a portion of the light source protrudes through the body; and a switch at least partially disposed within the body; wherein the switch operatively connects the light source and the power source; wherein the luminous assembly is configured to alternately activate or deactivate in response to depressing and releasing the light source; wherein the body comprises a nock; wherein the nock comprises an arrow or shaft attachment portion and a slot adapted to receive a bowstring; and wherein the luminous assembly is activated when the bowstring is withdrawn from the slot and the switch is closed.

In another respect, disclosed is a luminous assembly comprising: a body; a power source at least partially disposed within the body; a light source at least partially disposed within the body and wherein at least a portion of the light source protrudes through the body; and a switch at least partially disposed within the body; wherein the switch operatively connects the light source and the power source; wherein the luminous assembly is configured to alternately activate or deactivate in response to depressing and releasing the light source; wherein the body comprises a nock; wherein the nock comprises an arrow or shaft attachment portion and a slot adapted to receive a bowstring; and wherein at least a portion of the light source protrudes through and into the slot when the luminous assembly is in either an activated or deactivated state.

In another respect, disclosed is a luminous assembly comprising: a body; a power source at least partially disposed within the body; a light source at least partially disposed within the body and wherein at least a portion of the light source protrudes through the body; and a switch at least partially disposed within the body; wherein the switch operatively connects the light source and the power source; wherein the luminous assembly is configured to alternately activate or deactivate in response to depressing and releasing the light source; wherein the body comprises a nock; wherein the nock comprises an arrow or shaft attachment portion and a slot adapted to receive a bowstring; and wherein the slot comprises: a bottom; and a middle portion; wherein the bottom is adapted to receive the bowstring and wherein the middle portion is configured to retain the bowstring in the bottom of the slot.

In another respect, disclosed is a luminous assembly comprising: a body; a power source at least partially disposed within the body; a light source at least partially disposed within the body and wherein at least a portion of the light source protrudes through the body; a switch at least partially disposed within the body; and an adapter comprising an inner diameter and an outer diameter, wherein the inner diameter is configured to mate with the arrow or shaft attachment portion of the nock and wherein the outer diameter is configured to mate with an arrow or shaft; wherein the switch operatively connects the light source and the power source; wherein the luminous assembly is configured to alternately activate or deactivate in response to depressing and releasing the light source; wherein the body comprises a nock; and wherein the nock comprises an arrow or shaft attachment portion and a slot adapted to receive a bowstring.

In another respect, disclosed is a luminous assembly comprising: a body; a power source at least partially disposed within the body; a light source at least partially disposed within the body and wherein at least a portion of the light source protrudes through the body; and a switch at least partially disposed within the body; wherein the switch operatively connects the light source and the power source; wherein the luminous assembly is configured to alternately activate or deactivate in response to depressing and releasing the light source; wherein the body comprises a bolt end; and wherein the bolt end comprises a bolt attachment portion and a proximate end adapted to abut against a bowstring.

In another respect, disclosed is a luminous assembly comprising: a body; a power source at least partially disposed within the body; a light source at least partially disposed within the body and wherein at least a portion of the light source protrudes through the body; and a switch at least partially disposed within the body; wherein the switch operatively connects the light source and the power source; wherein the luminous assembly is configured to alternately activate or deactivate in response to depressing and releasing the light source; wherein the body comprises a bolt end; wherein the bolt end comprises a bolt attachment portion and a proximate end adapted to abut against a bowstring; and wherein the luminous assembly is activated when the bolt end is separated from the bowstring and the switch is closed.

In another respect, disclosed is a luminous assembly comprising: a body; a power source at least partially disposed within the body; a light source at least partially disposed within the body and wherein at least a portion of the light source protrudes through the body; and a switch at least partially disposed within the body; wherein the switch operatively connects the light source and the power source; wherein the luminous assembly is configured to alternately activate or deactivate in response to depressing and releasing the light source; wherein the body comprises a bolt end; wherein the bolt end comprises a bolt attachment portion and a proximate end adapted to abut against a bowstring; and wherein at least a portion of the light source protrudes through the proximate end when the luminous assembly is in either an activated or deactivated state.

In another respect, disclosed is a luminous assembly comprising: a body; a power source at least partially disposed within the body; a light source at least partially disposed within the body and wherein at least a portion of the light source protrudes through the body; a switch at least partially disposed within the body; and an adapter comprising an inner diameter and an outer diameter, wherein the inner diameter is configured to mate with the bolt or shaft attachment portion of the bolt end and wherein the outer diameter is configured to mate with a bolt or shaft; wherein the switch operatively connects the light source and the power source; wherein the luminous assembly is configured to alternately activate or deactivate in response to depressing and releasing the light source; wherein the body comprises a bolt end; wherein the bolt end comprises a bolt attachment portion and a proximate end adapted to abut against a bowstring.

In yet another respect, disclosed is a luminous assembly comprising: a body; a power source at least partially disposed within the body; a light source at least partially disposed within the body; a push member at least partially disposed within the body and wherein at least a portion of the push member protrudes through the body; and a switch at least partially disposed within the body; wherein the switch operatively connects the light source and the power source; and wherein the luminous assembly is configured to alternately activate or deactivate in response to depressing and releasing the push member.

In another respect, disclosed is a luminous assembly comprising: a body; a power source at least partially disposed within the body; a light source at least partially disposed within the body; a push member at least partially disposed within the body and wherein at least a portion of the push member protrudes through the body; and a switch at least partially disposed within the body; wherein the switch operatively connects the light source and the power source; wherein the luminous assembly is configured to alternately activate or deactivate in response to depressing and releasing the push member; wherein the body comprises a nock; and wherein the nock comprises an arrow or shaft attachment portion and a slot adapted to receive a bowstring.

In another respect, disclosed is a luminous assembly comprising: a body; a power source at least partially disposed within the body; a light source at least partially disposed within the body; a push member at least partially disposed within the body and wherein at least a portion of the push member protrudes through the body; and a switch at least partially disposed within the body; wherein the switch operatively connects the light source and the power source; wherein the luminous assembly is configured to alternately activate or deactivate in response to depressing and releasing the push member; wherein the body comprises a nock; wherein the nock comprises an arrow or shaft attachment portion and a slot adapted to receive a bowstring; and wherein the luminous assembly is activated when the bowstring is withdrawn from the slot and the switch is closed.

In another respect, disclosed is a luminous assembly comprising: a body; a power source at least partially disposed within the body; a light source at least partially disposed within the body; a push member at least partially disposed within the body and wherein at least a portion of the push member protrudes through the body; and a switch at least partially disposed within the body; wherein the switch operatively connects the light source and the power source; wherein the luminous assembly is configured to alternately activate or deactivate in response to depressing and releasing the push member; wherein the body comprises a nock; wherein the nock comprises an arrow or shaft attachment portion and a slot adapted to receive a bowstring; and wherein at least a portion of the push member protrudes through and into the slot when the luminous assembly is in either an activated or deactivated state.

In another respect, disclosed is a luminous assembly comprising: a body; a power source at least partially disposed within the body; a light source at least partially disposed within the body; a push member at least partially disposed within the body and wherein at least a portion of the push member protrudes through the body; and a switch at least partially disposed within the body; wherein the switch operatively connects the light source and the power source; wherein the luminous assembly is configured to alternately activate or deactivate in response to depressing and releasing the push member; wherein the body comprises a nock; wherein the nock comprises an arrow or shaft attachment portion and a slot adapted to receive a bowstring; and wherein the slot comprises: a bottom; and a middle portion; wherein the bottom is adapted to receive the bowstring and wherein the middle portion is configured to retain the bowstring in the bottom of the slot.

In another respect, disclosed is a luminous assembly comprising: a body; a power source at least partially disposed within the body; a light source at least partially disposed within the body; a push member at least partially disposed within the body and wherein at least a portion of the push member protrudes through the body; a switch at least partially disposed within the body; and an adapter comprising an inner diameter and an outer diameter, wherein the inner diameter is configured to mate with the arrow or shaft attachment portion of the nock and wherein the outer diameter is configured to mate with an arrow or shaft; wherein the switch operatively connects the light source and the power source; wherein the luminous assembly is configured to alternately activate or deactivate in response to depressing and releasing the push member; wherein the body comprises a nock; and wherein the nock comprises an arrow or shaft attachment portion and a slot adapted to receive a bowstring.

In another respect, disclosed is a luminous assembly comprising: a body; a power source at least partially disposed within the body; a light source at least partially disposed within the body; a push member at least partially disposed within the body and wherein at least a portion of the push member protrudes through the body; and a switch at least partially disposed within the body; wherein the switch operatively connects the light source and the power source; wherein the luminous assembly is configured to alternately activate or deactivate in response to depressing and releasing the push member; wherein the body comprises a bolt end; and wherein the bolt end comprises a bolt attachment portion and a proximate end adapted to abut against a bowstring.

In another respect, disclosed is a luminous assembly comprising: a body; a power source at least partially disposed within the body; a light source at least partially disposed within the body; a push member at least partially disposed within the body and wherein at least a portion of the push member protrudes through the body; and a switch at least partially disposed within the body; wherein the switch operatively connects the light source and the power source; wherein the luminous assembly is configured to alternately activate or deactivate in response to depressing and releasing the push member; wherein the body comprises a bolt end; wherein the bolt end comprises a bolt attachment portion and a proximate end adapted to abut against a bowstring; and wherein the luminous assembly is activated when the bolt end is separated from the bowstring and the switch is closed.

In another respect, disclosed is a luminous assembly comprising: a body; a power source at least partially disposed within the body; a light source at least partially disposed within the body; a push member at least partially disposed within the body and wherein at least a portion of the push member protrudes through the body; and a switch at least partially disposed within the body; wherein the switch operatively connects the light source and the power source; wherein the luminous assembly is configured to alternately activate or deactivate in response to depressing and releasing the push member; wherein the body comprises a bolt end; wherein the bolt end comprises a bolt attachment portion and a proximate end adapted to abut against a bowstring; and wherein at least a portion of the push member protrudes through the proximate end when the luminous assembly is in either an activated or deactivated state.

In another respect, disclosed is a luminous assembly comprising: a body; a power source at least partially disposed within the body; a light source at least partially disposed within the body; a push member at least partially disposed within the body and wherein at least a portion of the push member protrudes through the body; a switch at least partially disposed within the body; and an adapter comprising an inner diameter and an outer diameter, wherein the inner diameter is configured to mate with the bolt or shaft attachment portion of the bolt end and wherein the outer diameter is configured to mate with a bolt or shaft; wherein the switch operatively connects the light source and the power source; wherein the luminous assembly is configured to alternately activate or deactivate in response to depressing and releasing the push member; wherein the body comprises a bolt end; wherein the bolt end comprises a bolt attachment portion and a proximate end adapted to abut against a bowstring.

In yet another respect, disclosed is a lighted bolt end comprising: a bolt end body comprising: a bolt or shaft attachment portion; and a proximate end adapted to abut against a bowstring; and a luminous assembly at least partially disposed within the bolt end body, wherein the luminous assembly comprises a power source, a light source, and a switch; wherein the luminous assembly is configured to alternately activate or deactivate in response to depressing and releasing of the switch.

In another respect, disclosed is a lighted bolt end comprising: a bolt end body comprising: a bolt or shaft attachment portion; and a proximate end adapted to abut against a bowstring; and a luminous assembly at least partially disposed within the bolt end body, wherein the luminous assembly comprises a power source, a light source, and a switch; wherein the luminous assembly is configured to alternately activate or deactivate in response to depressing and releasing of the switch; and wherein the luminous assembly is activated when the bolt end is separated from the bowstring and the switch is closed.

In another respect, disclosed is a lighted bolt end comprising: a bolt end body comprising: a bolt or shaft attachment portion; and a proximate end adapted to abut against a bowstring; and a luminous assembly at least partially disposed within the bolt end body, wherein the luminous assembly comprises a power source, a light source, and a switch; wherein the luminous assembly is configured to alternately activate or deactivate in response to depressing and releasing of the switch; and wherein at least a portion of the switch protrudes through the proximate end when the luminous assembly is in either an activated or deactivated state.

In another respect, disclosed is a lighted bolt end comprising: a bolt end body comprising: a bolt or shaft attachment portion; and a proximate end adapted to abut against a bowstring; a luminous assembly at least partially disposed within the bolt end body, wherein the luminous assembly comprises a power source, a light source, and a switch; and an adapter comprising an inner diameter and an outer diameter, wherein the inner diameter is configured to mate with the bolt or shaft attachment portion of the bolt end body and wherein the outer diameter is configured to mate with a bolt or shaft; wherein the luminous assembly is configured to alternately activate or deactivate in response to depressing and releasing of the switch.

In yet another respect, disclosed is a lighted bolt end comprising: a bolt end body comprising: a bolt or shaft attachment portion; and a proximate end adapted to abut against a bowstring; and a luminous assembly at least partially disposed within the bolt end body, wherein the luminous assembly comprises a power source, a light source, and a switch; wherein the luminous assembly is configured to alternately activate or deactivate in response to depressing and releasing of the light source.

In another respect, disclosed is a lighted bolt end comprising: a bolt end body comprising: a bolt or shaft attachment portion; and a proximate end adapted to abut against a bowstring; and a luminous assembly at least partially disposed within the bolt end body, wherein the luminous assembly comprises a power source, a light source, and a switch; wherein the luminous assembly is configured to alternately activate or deactivate in response to depressing and releasing of the light source; and wherein the luminous assembly is activated when the bolt end is separated from the bowstring and the switch is closed.

In another respect, disclosed is a lighted bolt end comprising: a bolt end body comprising: a bolt or shaft attachment portion; and a proximate end adapted to abut against a bowstring; and a luminous assembly at least partially disposed within the bolt end body, wherein the luminous assembly comprises a power source, a light source, and a switch; wherein the luminous assembly is configured to alternately activate or deactivate in response to depressing and releasing of the light source; and wherein at least a portion of the light source protrudes through the proximate end when the luminous assembly is in either an activated or deactivated state.

In another respect, disclosed is a lighted bolt end comprising: a bolt end body comprising: a bolt or shaft attachment portion; and a proximate end adapted to abut against a bowstring; a luminous assembly at least partially disposed within the bolt end body, wherein the luminous assembly comprises a power source, a light source, and a switch; and an adapter comprising an inner diameter and an outer diameter, wherein the inner diameter is configured to mate with the bolt or shaft attachment portion of the bolt end body and wherein the outer diameter is configured to mate with a bolt or shaft; wherein the luminous assembly is configured to alternately activate or deactivate in response to depressing and releasing of the light source.

In yet another respect, disclosed is a lighted bolt end comprising: a bolt end body comprising: a bolt or shaft attachment portion; and a proximate end adapted to abut against a bowstring; a push member at least partially disposed within the bolt end body; and a luminous assembly at least partially disposed within the bolt end body, wherein the luminous assembly comprises a power source, a light source, and a switch; wherein the luminous assembly is configured to alternately activate or deactivate in response to depressing and releasing of the push member.

In another respect, disclosed is a lighted bolt end comprising: a bolt end body comprising: a bolt or shaft attachment portion; and a proximate end adapted to abut against a bowstring; a push member at least partially disposed within the bolt end body; and a luminous assembly at least partially disposed within the bolt end body, wherein the luminous assembly comprises a power source, a light source, and a switch; wherein the luminous assembly is configured to alternately activate or deactivate in response to depressing and releasing of the push member; and wherein the luminous assembly is activated when the bolt end is separated from the bowstring and the switch is closed.

In another respect, disclosed is a lighted bolt end comprising: a bolt end body comprising: a bolt or shaft attachment portion; and a proximate end adapted to abut against a bowstring; a push member at least partially disposed within the bolt end body; and a luminous assembly at least partially disposed within the bolt end body, wherein the luminous assembly comprises a power source, a light source, and a switch; wherein the luminous assembly is configured to alternately activate or deactivate in response to depressing and releasing of the push member; and wherein at least a portion of the push member protrudes through the proximate end when the luminous assembly is in either an activated or deactivated state.

In another respect, disclosed is a lighted bolt end comprising: a bolt end body comprising: a bolt or shaft attachment portion; and a proximate end adapted to abut against a bowstring; a push member at least partially disposed within the bolt end body; a luminous assembly at least partially disposed within the bolt end body, wherein the luminous assembly comprises a power source, a light source, and a switch; and an adapter comprising an inner diameter and an outer diameter, wherein the inner diameter is configured to mate with the bolt or shaft attachment portion of the bolt end body and wherein the outer diameter is configured to mate with a bolt or shaft; wherein the luminous assembly is configured to alternately activate or deactivate in response to depressing and releasing of the push member.

In yet another respect, disclosed is a lighted bolt end comprising: a bolt end body comprising: a bolt or shaft attachment portion; and a proximate end adapted to abut against a bowstring; and a luminous assembly at least partially disposed within the bolt end body, wherein the luminous assembly comprises a power source, a light source, a push member, and a switch; wherein the luminous assembly is configured to alternately activate or deactivate in response to depressing and releasing of the push member.

In another respect, disclosed is a lighted bolt end comprising: a bolt end body comprising: a bolt or shaft attachment portion; and a proximate end adapted to abut against a bowstring; and a luminous assembly at least partially disposed within the bolt end body, wherein the luminous assembly comprises a power source, a light source, a push member, and a switch; wherein the luminous assembly is configured to alternately activate or deactivate in response to depressing and releasing of the push member; and wherein the luminous assembly is activated when the bolt end is separated from the bowstring and the switch is closed.

In another respect, disclosed is a lighted bolt end comprising: a bolt end body comprising: a bolt or shaft attachment portion; and a proximate end adapted to abut against a bowstring; and a luminous assembly at least partially disposed within the bolt end body, wherein the luminous assembly comprises a power source, a light source, a push member, and a switch; wherein the luminous assembly is configured to alternately activate or deactivate in response to depressing and releasing of the push member; and wherein at least a portion of the push member protrudes through the proximate end when the luminous assembly is in either an activated or deactivated state.

In another respect, disclosed is a lighted bolt end comprising: a bolt end body comprising: a bolt or shaft attachment portion; and a proximate end adapted to abut against a bowstring; a luminous assembly at least partially disposed within the bolt end body, wherein the luminous assembly comprises a power source, a light source, a push member, and a switch; and an adapter comprising an inner diameter and an outer diameter, wherein the inner diameter is configured to mate with the bolt or shaft attachment portion of the bolt end body and wherein the outer diameter is configured to mate with a bolt or shaft; wherein the luminous assembly is configured to alternately activate or deactivate in response to depressing and releasing of the push member.

In yet another respect, disclosed is a method for illuminating a nock, comprising: providing a nock having: a nock body comprising: an arrow or shaft attachment portion; and a slot adapted to receive a bowstring; and a luminous assembly at least partially disposed within the nock body, wherein the luminous assembly comprises a power source, a light source, and a switch; wherein the luminous assembly is alternately activated or deactivated in response to depressing and releasing of the switch; drawing the bowstring; and releasing the bowstring, thereby withdrawing the bowstring from the slot and illuminating the nock.

In yet another respect, disclosed is a method for illuminating a nock, comprising: providing a nock having: a nock body comprising: an arrow or shaft attachment portion; and a slot adapted to receive a bowstring; and a luminous assembly at least partially disposed within the nock body, wherein the luminous assembly comprises a power source, a light source, and a switch; wherein the luminous assembly is alternately activated or deactivated in response to depressing and releasing of the light source; drawing the bowstring; and releasing the bowstring, thereby withdrawing the bowstring from the slot and illuminating the nock.

In yet another respect, disclosed is a method for illuminating a nock, comprising: providing a nock having: a nock body comprising: an arrow or shaft attachment portion; and a slot adapted to receive a bowstring; a push member at least partially dispose within the nock body; and a luminous assembly at least partially disposed within the nock body, wherein the luminous assembly comprises a power source, a light source, and a switch; wherein the luminous assembly is alternately activated or deactivated in response to depressing and releasing of the push member; drawing the bowstring; and releasing the bowstring, thereby withdrawing the bowstring from the slot and illuminating the nock.

In yet another respect, disclosed is a method for illuminating a nock, comprising: providing a nock having: a nock body comprising: an arrow or shaft attachment portion; and a slot adapted to receive a bowstring; and a luminous assembly at least partially disposed within the nock body, wherein the luminous assembly comprises a power source, a light source, a push member, and a switch; wherein the luminous assembly is alternately activated or deactivated in response to depressing and releasing of the push member; drawing the bowstring; and releasing the bowstring, thereby withdrawing the bowstring from the slot and illuminating the nock.

In yet another respect, disclosed is a method for illuminating a bolt end, comprising: providing a bolt end having: a bolt end body comprising: a bolt or shaft attachment portion; and a proximate end adapted to abut against a bowstring; and a luminous assembly at least partially disposed within the bolt end body, wherein the luminous assembly comprises a power source, a light source, and a switch; wherein the luminous assembly is alternately activated or deactivated in response to depressing and releasing of the switch; drawing the bowstring; and releasing the bowstring, thereby separating the bolt end from the bowstring and illuminating the bolt end.

In yet another respect, disclosed is a method for illuminating a bolt end, comprising: providing a bolt end having: a bolt end body comprising: a bolt or shaft attachment portion; and a proximate end adapted to abut against a bowstring; and a luminous assembly at least partially disposed within the bolt end body, wherein the luminous assembly comprises a power source, a light source, and a switch; wherein the luminous assembly is alternately activated or deactivated in response to depressing and releasing of the light source; drawing the bowstring; and releasing the bowstring, thereby separating the bolt end from the bowstring and illuminating the bolt end.

In yet another respect, disclosed is a method for illuminating a bolt end, comprising: providing a bolt end having: a bolt end body comprising: a bolt or shaft attachment portion; and a proximate end adapted to abut against a bowstring; a push member at least partially disposed within the bolt end body; and a luminous assembly at least partially disposed within the bolt end body, wherein the luminous assembly comprises a power source, a light source, and a switch; wherein the luminous assembly is alternately activated or deactivated in response to depressing and releasing of the push member; drawing the bowstring; and releasing the bowstring, thereby separating the bolt end from the bowstring and illuminating the bolt end.

In yet another respect, disclosed is a method for illuminating a bolt end, comprising: providing a bolt end having: a bolt end body comprising: a bolt or shaft attachment portion; and a proximate end adapted to abut against a bowstring; and a luminous assembly at least partially disposed within the bolt end body, wherein the luminous assembly comprises a power source, a light source, a push member, and a switch; wherein the luminous assembly is alternately activated or deactivated in response to depressing and releasing of the push member; drawing the bowstring; and releasing the bowstring, thereby separating the bolt end from the bowstring and illuminating the bolt end.

Numerous additional embodiments are also possible.

IV. BRIEF DESCRIPTION OF THE DRAWINGS

Other objects and advantages of the invention may become apparent upon reading the detailed description and upon reference to the accompanying drawings.

Figure 6A:
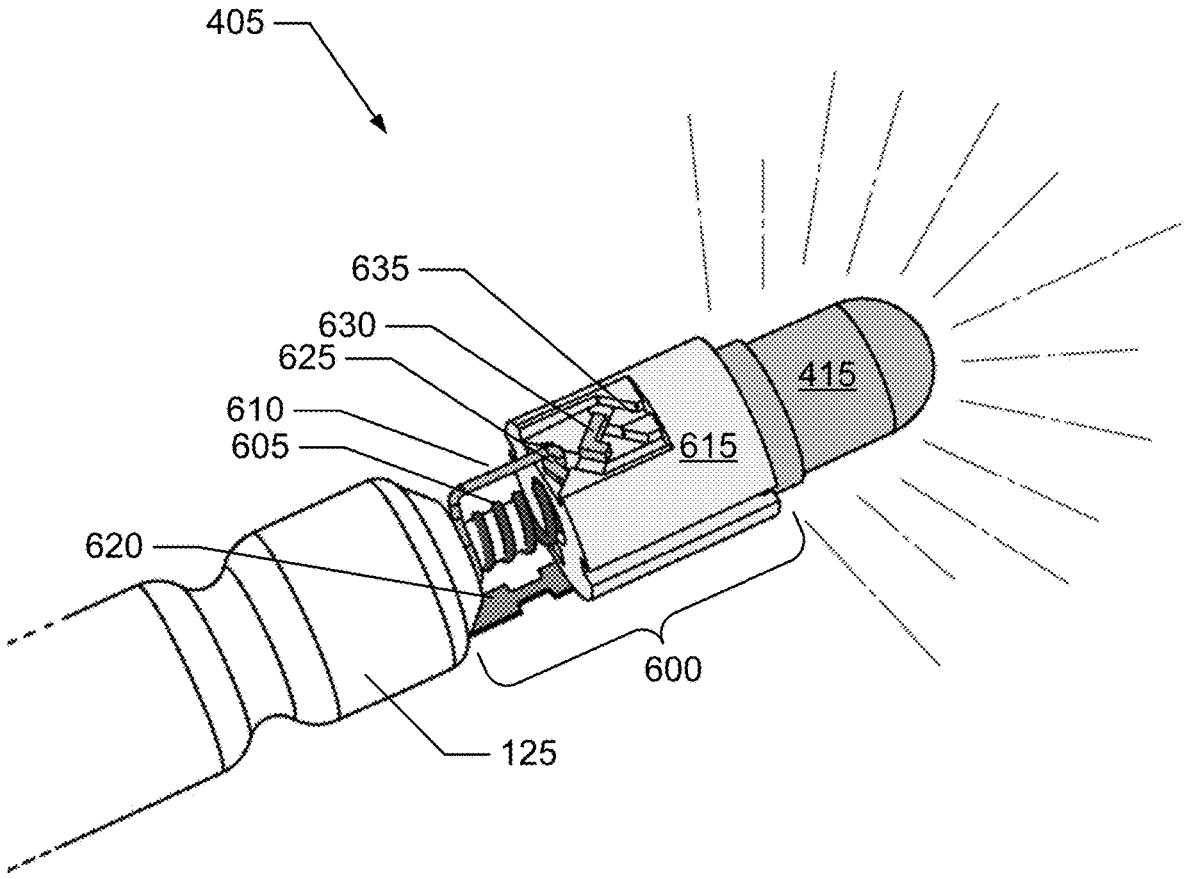
Figure 6B:
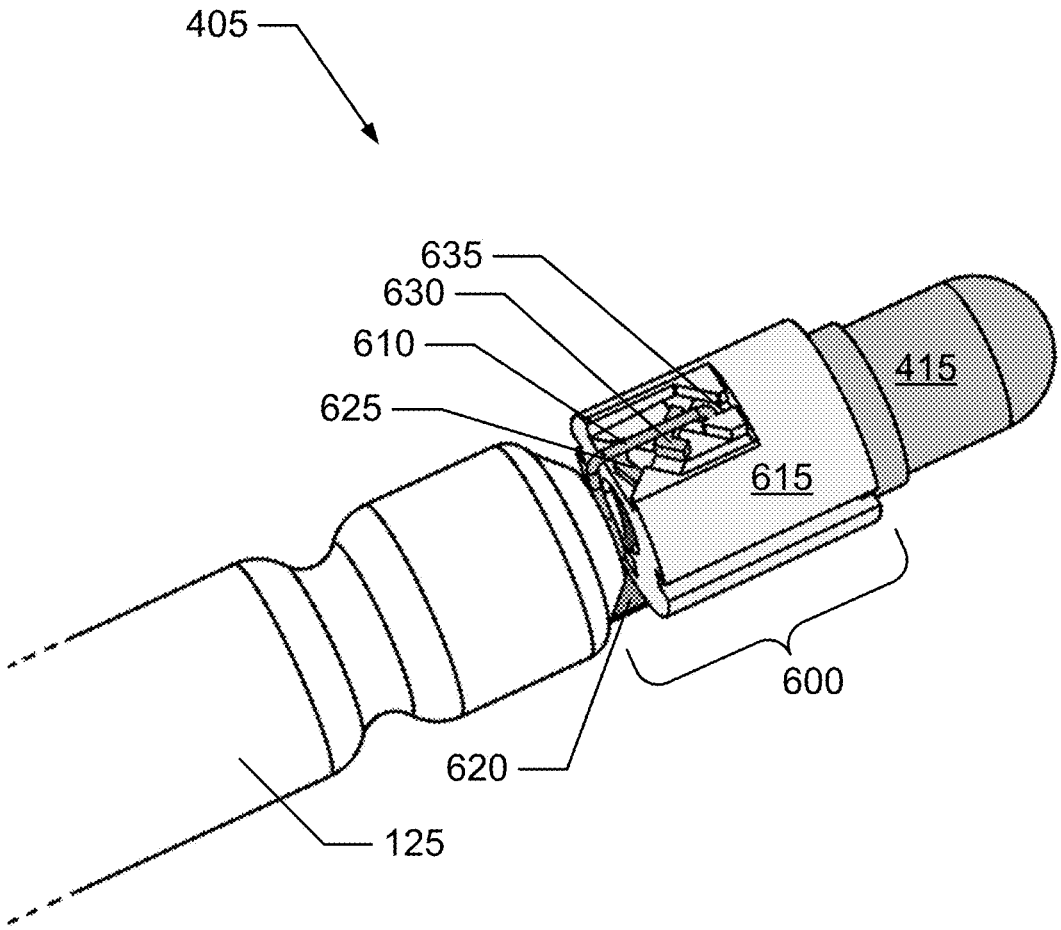
Figure 6C:
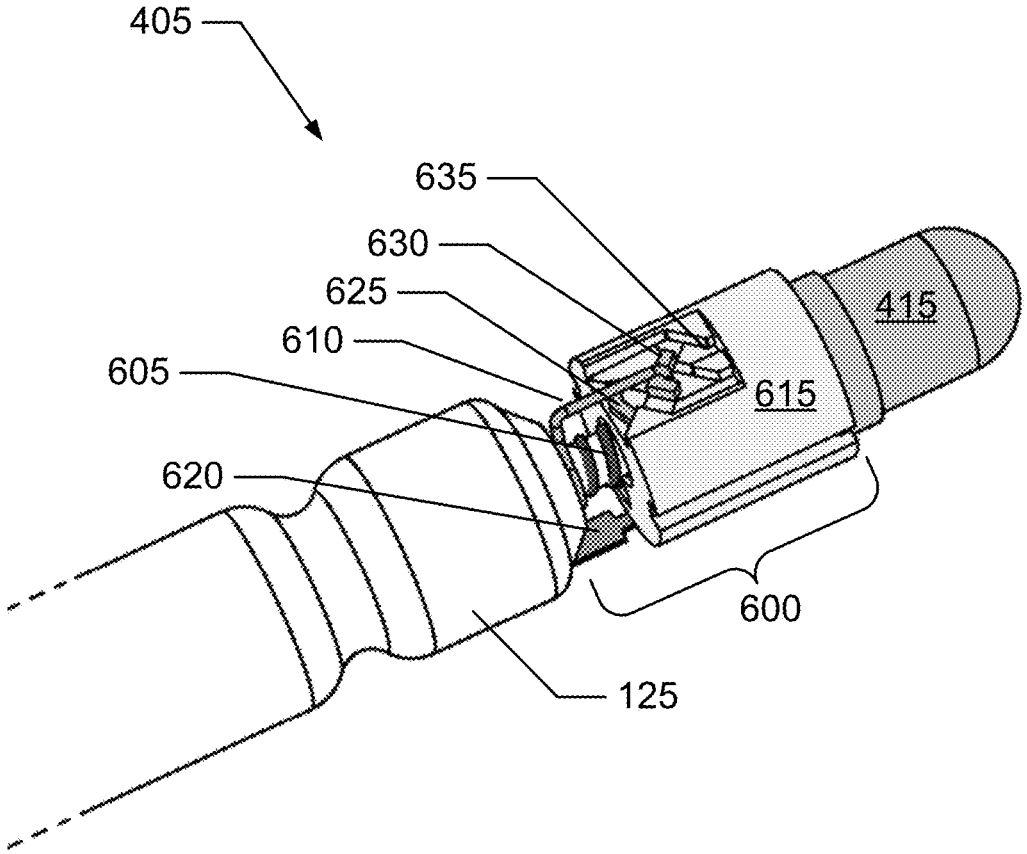

FIG. 6A, FIG. 6B, and FIG. 6C are side perspectives of a luminous assembly in the on, depressed, and off states, respectively, in accordance with some embodiments.

Figure 7A:
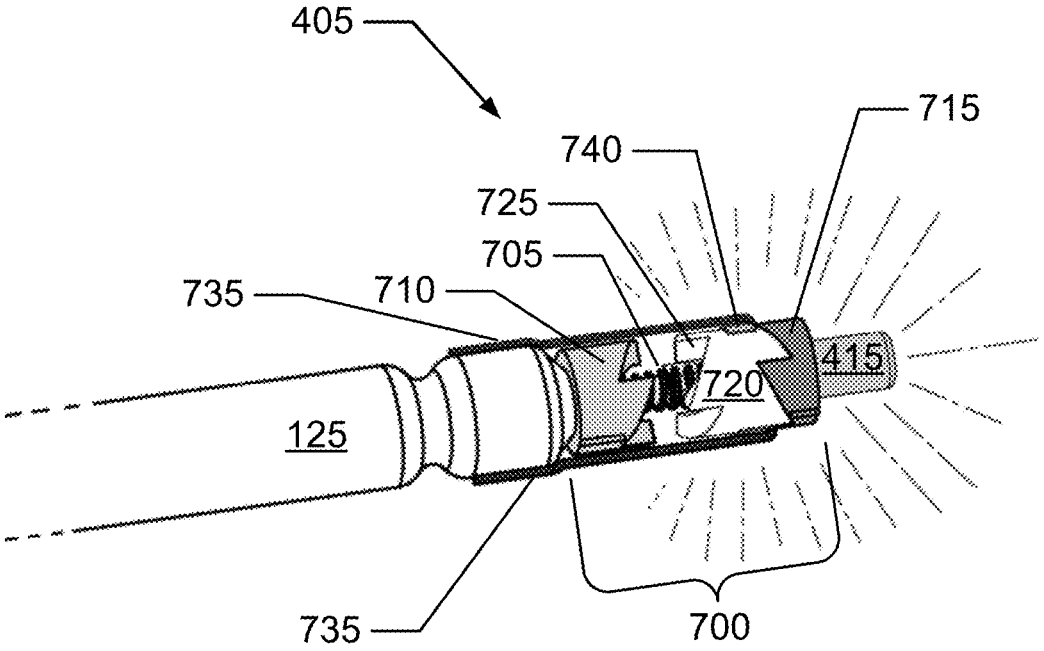
Figure 7B:
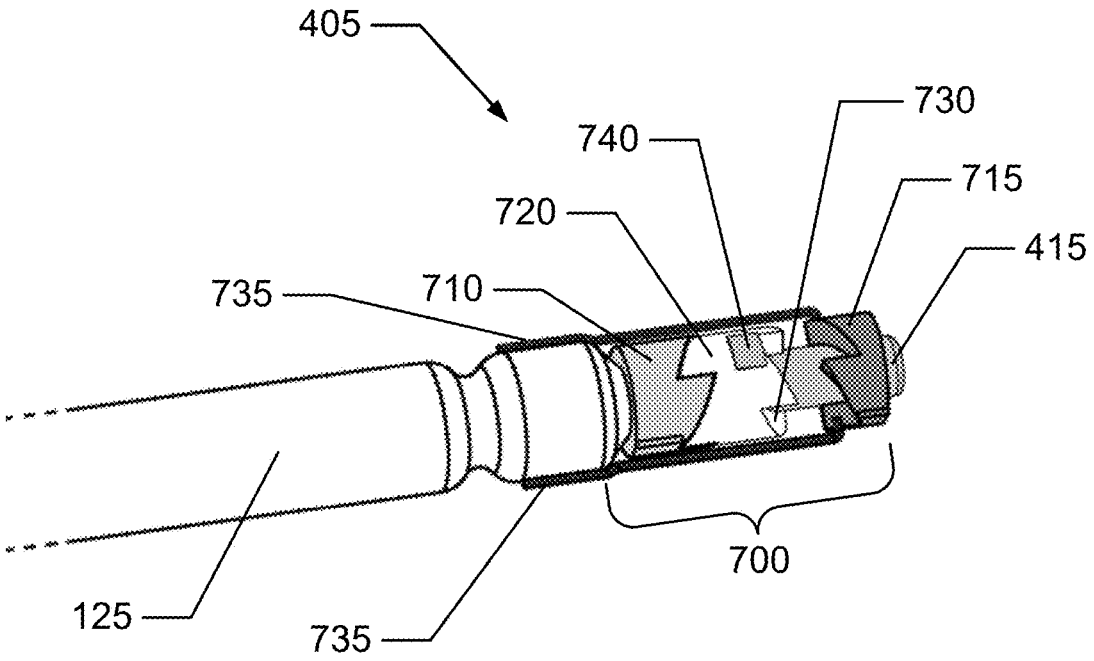
Figure 7C:
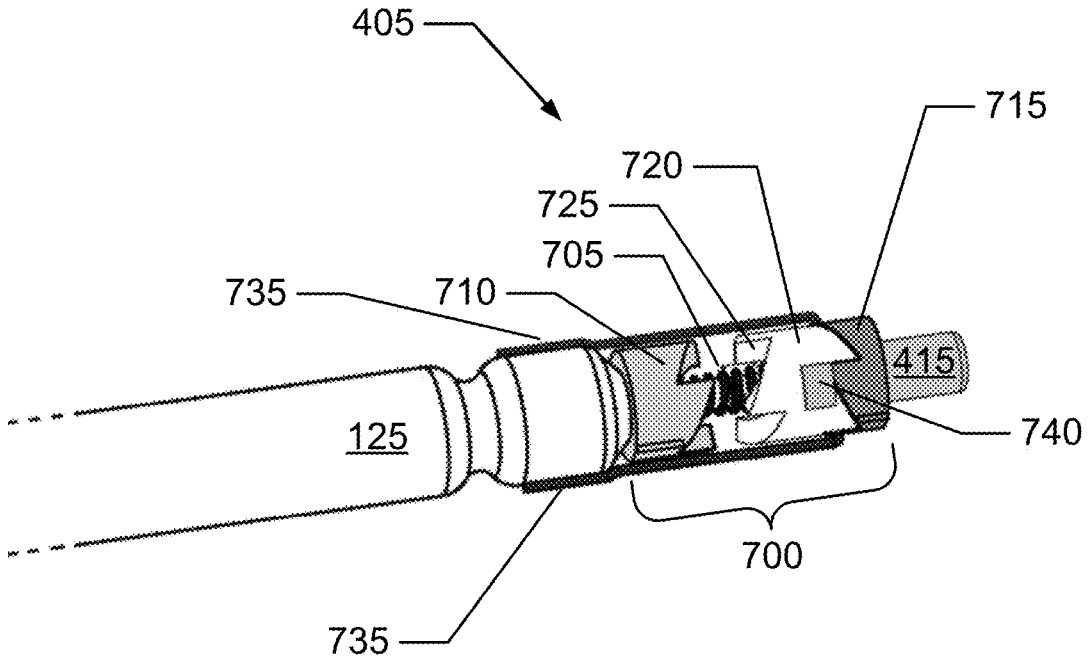

FIG. 7A, FIG. 7B, and FIG. 7C are side perspectives of a luminous assembly in the on, depressed, and off states, respectively, in accordance with some embodiments.

Figure 8A:
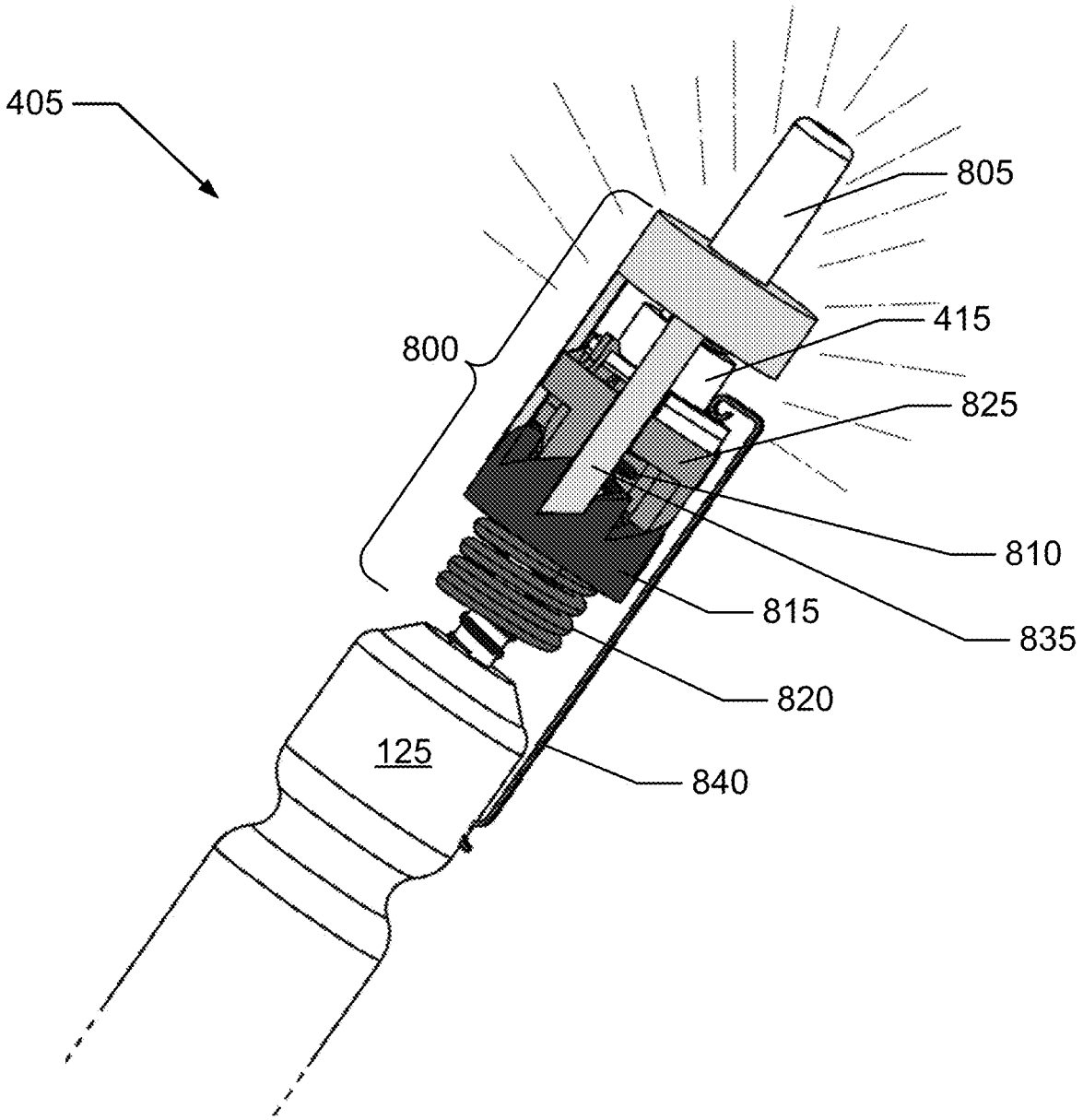
Figure 8B:
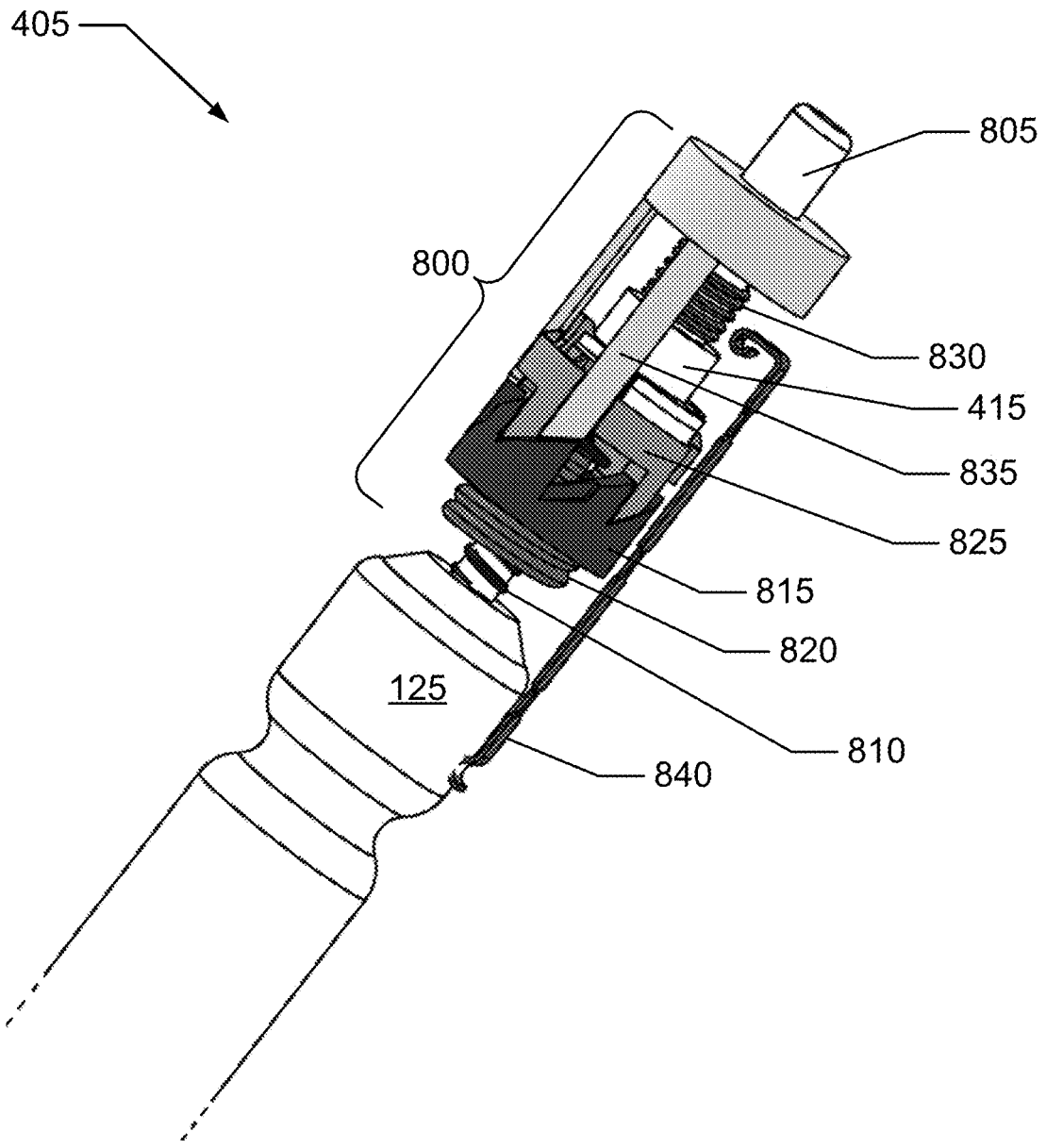
Figure 8C:
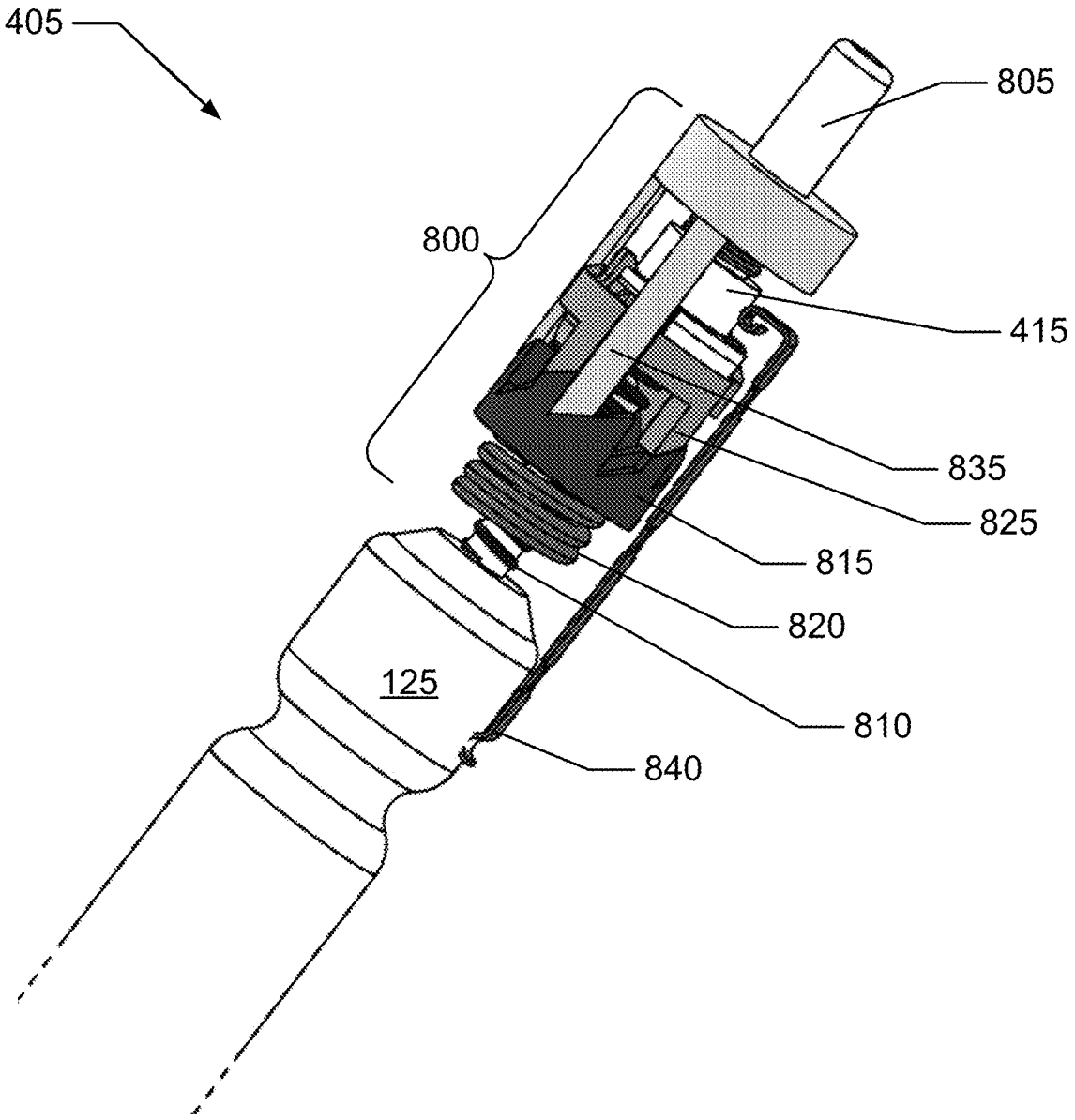

FIG. 8A, FIG. 8B, and FIG. 8C are side perspectives of a luminous assembly in the on, depressed, and off states, respectively, in accordance with some embodiments.

Figure 9A:
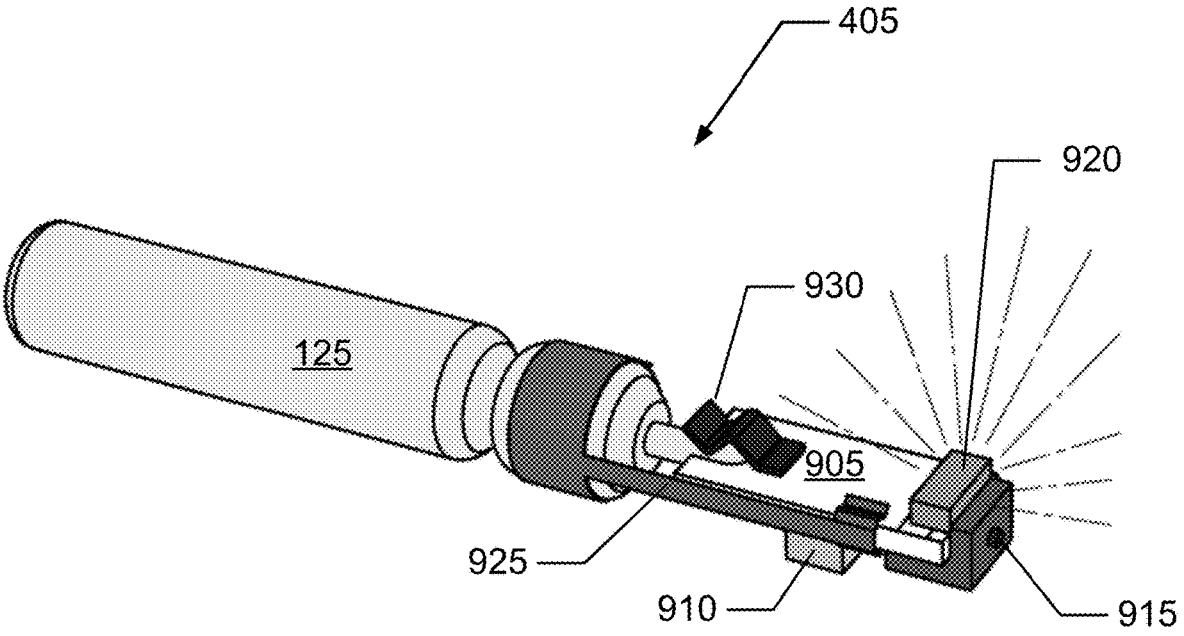
Figure 9B:
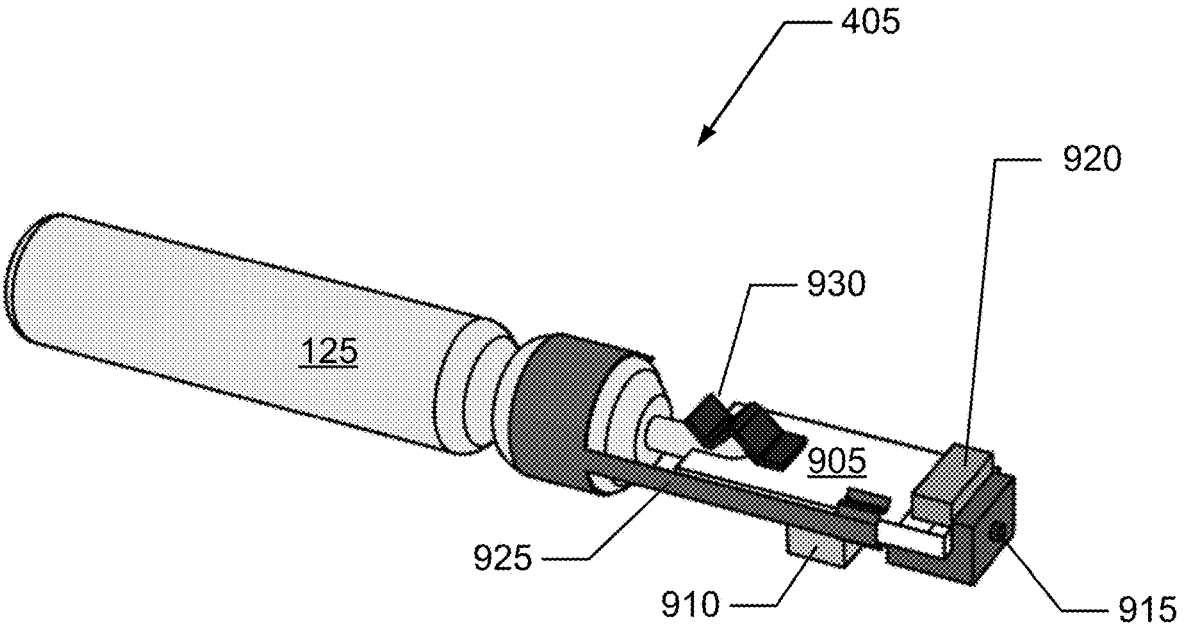

FIG. 9A and FIG. 9B are side perspectives of a luminous assembly in the on and off states, respectively, in accordance with some embodiments.

Figure 10:
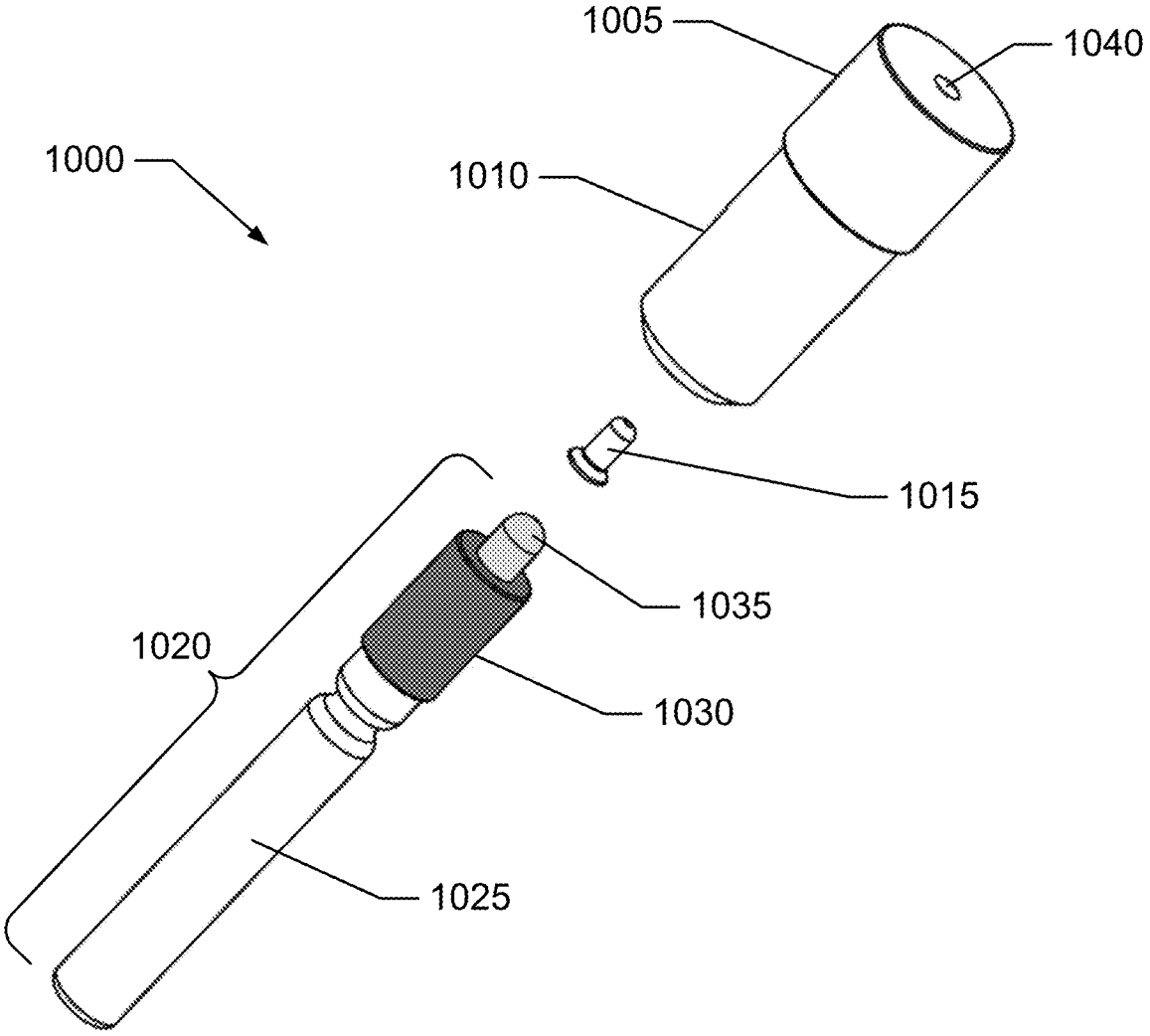

FIG. 10 is an exploded side perspective of a lighted bolt end device, in accordance with some embodiments.

Figure 11:
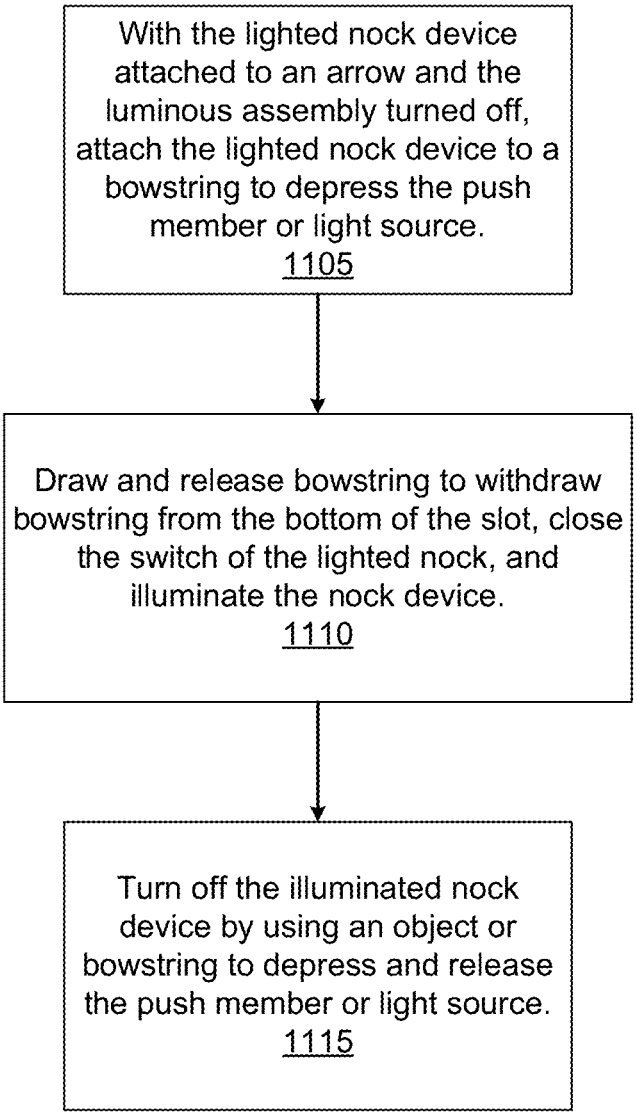

FIG. 11 is a flowchart illustrating a method for using a lighted nock device, in accordance with some embodiments.

Figure 12:
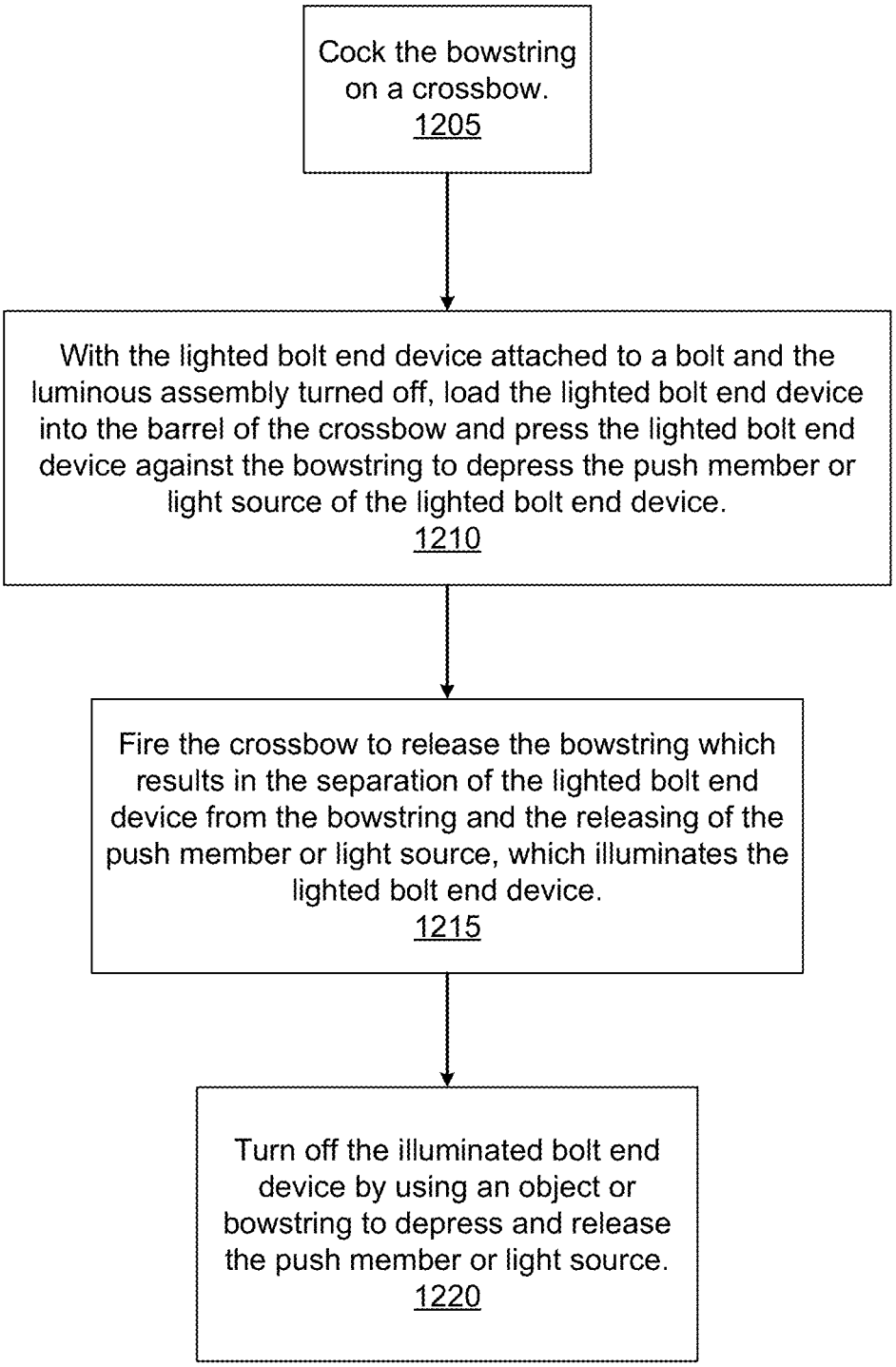

FIG. 12 is a flowchart illustrating a method for using a lighted bolt end device, in accordance with some embodiments.

While the invention is subject to various modifications and alternative forms, specific embodiments thereof are shown by way of example in the drawings and the accompanying detailed description. It should be understood, however, that the drawings and detailed description are not intended to limit the invention to the particular embodiments. This disclosure is instead intended to cover all modifications, equivalents, and alternatives falling within the scope of the present invention as defined by the appended claims.

V. DETAILED DESCRIPTION

One or more embodiments of the invention are described below. It should be noted that these and any other embodiments are exemplary and are intended to be illustrative of the invention rather than limiting. While the invention is widely applicable to different types of systems, it is impossible to include all of the possible embodiments and contexts of the invention in this disclosure. Upon reading this disclosure, many alternative embodiments of the present invention will be apparent to persons of ordinary skill in the art.

A lighted nock device for an arrow allows an archer to be able to more easily see the arrow in flight, see the point of arrow impact, and recover the arrow after a shot. Every archer can benefit from using a lighted nock device. Being able to observe the arrow in flight and see the point of impact helps the archer to diagnose problems with shooting form or bow setup and make appropriate adjustments. Perhaps more importantly, a lighted nock device allows an archer to recover the arrow.

Bow hunters can especially benefit from using an arrow with a lighted nock device. Recovering an arrow that was shot at an animal is critical in the ethical harvest of animals, and a lighted nock device allows a bow hunter to recover the arrow and animal more easily. Upon recovering the arrow, the bow hunter can diagnose many things about the shot by inspecting the arrow. The presence of blood or other debris on the arrow, or lack thereof, gives many clues as to if the arrow impacted the animal in a desired vital area or not, or if the arrow even hit the animal at all.

U.S. Pat. No. 8,758,177, issued Jun. 24, 2014 to Stuart Minica, is a lighted nock which uses a commercially available light source assembly comprising a battery powered light emitting diode (LED) with an internal single pole switch. The U.S. Pat. No. 8,758,177 device requires two portions of a nock body to activate the LED; a first portion to receive the bowstring before it is released and a second portion to receive the bowstring after it is released. Having two portions adds to the overall length and weight of the lighted nock device. Additionally, this two portion device adds unnecessary disturbance to the arrow flight due to the nock flight being interrupted on the bowstring as the bowstring transitions from the first portion of the nock body into the second portion of the nock body as the bowstring pushes on the arrow upon release of the bowstring as well as when the bowstring transitions from the second portion of the nock body to the first portion of the nock body as the arrow leaves the bowstring. The two portion device is more complicated to manufacture than a conventional nock body with only a single portion. The U.S. Pat. No. 8,758,177 device also utilizes an open hole or reset aperture in the nock to be able to turn off the LED. The open hole allows the user to turn off the LED of the lighted nock device, but the open hole also allows moisture, dust, or other debris such as blood and tissue from animals to enter the nock which can negatively affect its function and reliability. Additionally, the hole weakens the structural integrity of the nock and thereby requires a thicker than necessary nock cross section of material to compensate for the absence of material in the hole. This too increases the weight of the device and complicates the design and manufacturing of the device.

U.S. Pat. No. 6,123,631, issued on Sep. 26, 2000 to Jeffery Allen Ginder, utilizes a battery-powered LED which is always in the on state unless the arrow is nocked on the bowstring or a special cap is attached to the nock. Such a cap can become easily lost and ultimately render the lighted lock useless since the battery would be drained without this special cap in place. Additionally, in bow hunting situations, when nocking the arrow, the cap would have to be removed and in doing so, the LED would be turned on before being turned off again by the bowstring. This activation of the LED may alert the animal of the presence of the bow hunter and thus possibly ruin the opportunity of the hunt. The use of the special caps also adds to the time is takes for a hunter to nock an arrow to their bow, which is important in cases of making a quick second shot of a target.

The embodiment or embodiments described herein may solve these shortcomings as well as others by proposing a novel illuminated nock device having a single bowstring reception portion with reduced nock body length and weight that will illuminate upon release from a bowstring, is more dependable, doesn't require any extra parts, assembly, or preparation work by the user, and is toggled on and off by the direct or indirect depressing and releasing of an integrated switch.

Figure 1:
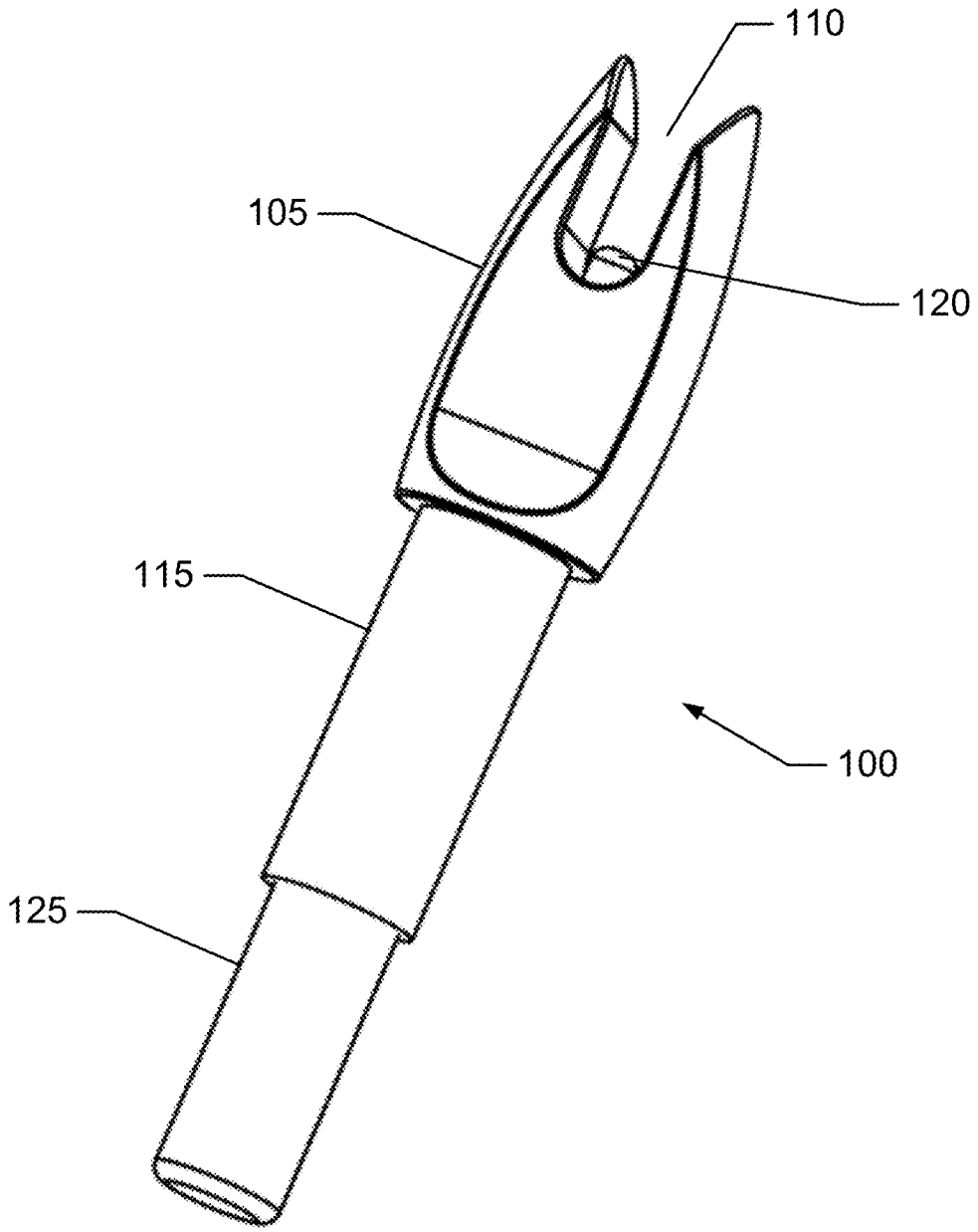
FIG. 1 is a side perspective of a lighted nock device in the "Off" non-illuminated state, in accordance with some embodiments.

FIG. 1 is a side perspective of a lighted nock device in the "Off" non-illuminated state, in accordance with some embodiments.

In some embodiments, the lighted nock device 100 comprises a nock body 105 having a slot 110 for attaching to a bowstring, an arrow or shaft attachment portion 115, a push member 120 located at least partially within nock body 105, and a power source 125. A luminous assembly (described in further detail with respect to FIG. 4, FIG. 6A, FIG. 6B, FIG. 6C, FIG. 7A, FIG. 7B, FIG. 7C, FIG. 8A, FIG. 8B, FIG. 8C, FIG. 9A, FIG. 9B, and FIG. 10) comprises the power source 125, a switch (not shown), and a light source such as an LED (not shown). A portion of the push member 120 passes through an opening in the nock body 105 into the bottom of the slot 110 to allow for the turning on and off of the luminous assembly by the depressing and releasing of the push member. In some embodiments, the light source is configured to also act as the push member 120.

In some embodiments, power source 125 is a tubular dry cell battery, such as (but not limited to) a common alkaline, zinc-air, lithium, lithium ion, or other small cell currently known or in use today.

In some embodiments, nock body 105 and arrow or shaft attachment portion 115 are formed of a monolithic piece of rigid material, such as (but not limited to) metal, plastic, polycarbonate, compounds thereof and the like, all of which are well known in the art for their suitability for arrow nock material. Alternatively, nock body 105 may be formed from one or more pieces of rigid material and then joined together via conventional means. Such forming and/or joining may be accomplished through any methods known in the art for producing metal and plastic materials. Accordingly, the method of making the nock body is not further discussed herein.

In some embodiments, the arrow or shaft attachment portion 115 is configured to be inserted into an adapter having an inner diameter configured to mate with the outer diameter of the arrow or shaft attachment portion 115. The adapter has an outer diameter larger than the outer diameter of the arrow or shaft attachment portion 115 and is configured to be used as a bushing between the lighted nock device 100 and an arrow with a larger diameter than the arrow or shaft attachment portion 115.

In some embodiments, the luminous assembly may form an integrated package. Various other sources of these components, and alternate arrangements are possible. Although separate power source, light source, and switch are described, those skilled in the art will realize that integrated assemblies of some or all of these components may also be used. Accordingly, the concepts, apparatus, and techniques described herein are not limited to any particular packaging of these components.

Figure 2:
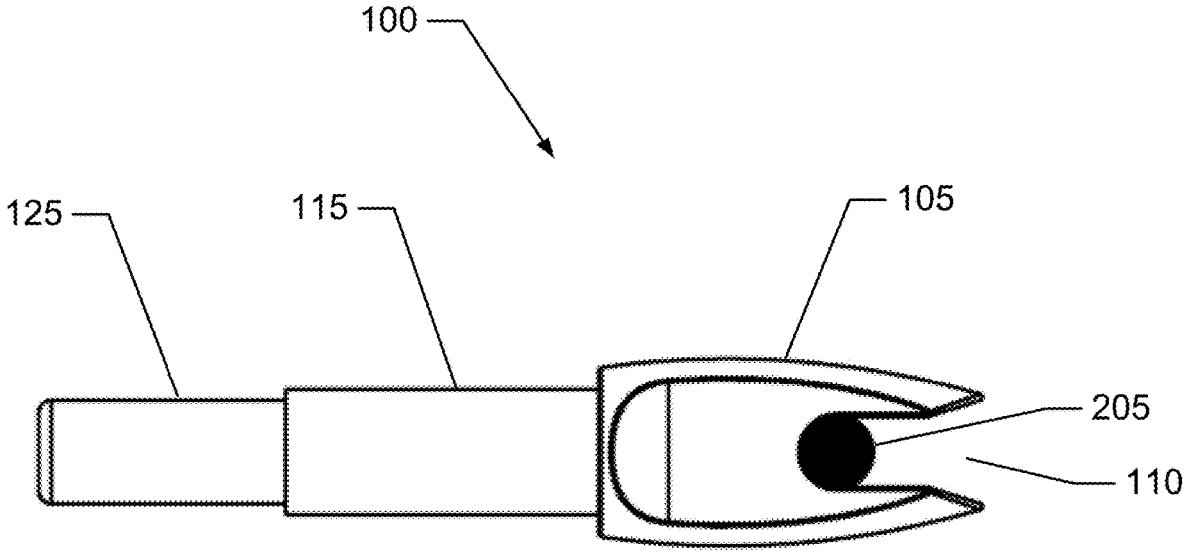
FIG. 2 is a top perspective of a lighted nock device in the "Off" non-illuminated state, in accordance with some embodiments.

FIG. 2 is a top perspective of a lighted nock device in the "Off" non-illuminated state, in accordance with some embodiments.

In some embodiments, the lighted nock device 100 comprises the nock body 105 having a slot 110 for attaching to a bowstring 205, an arrow or shaft attachment portion 115, and a power source 125. When the lighted nock device 100 is placed or nocked onto the bowstring 205, the bowstring 205 sits fully into the bottom of the slot 110 depressing the push member 120 (shown in FIG. 1) and the light source away from the slot 110 while the switch (not shown) of the luminous assembly remains in the open position (luminous assembly turned off). Only upon release of the lighted nock device 100 from the bowstring 205, i.e. the withdrawal of the bowstring from the bottom of the slot, will the switch be allowed to move into the closed position to activate the luminous assembly as illustrated in FIG. 3.

Figure 3:
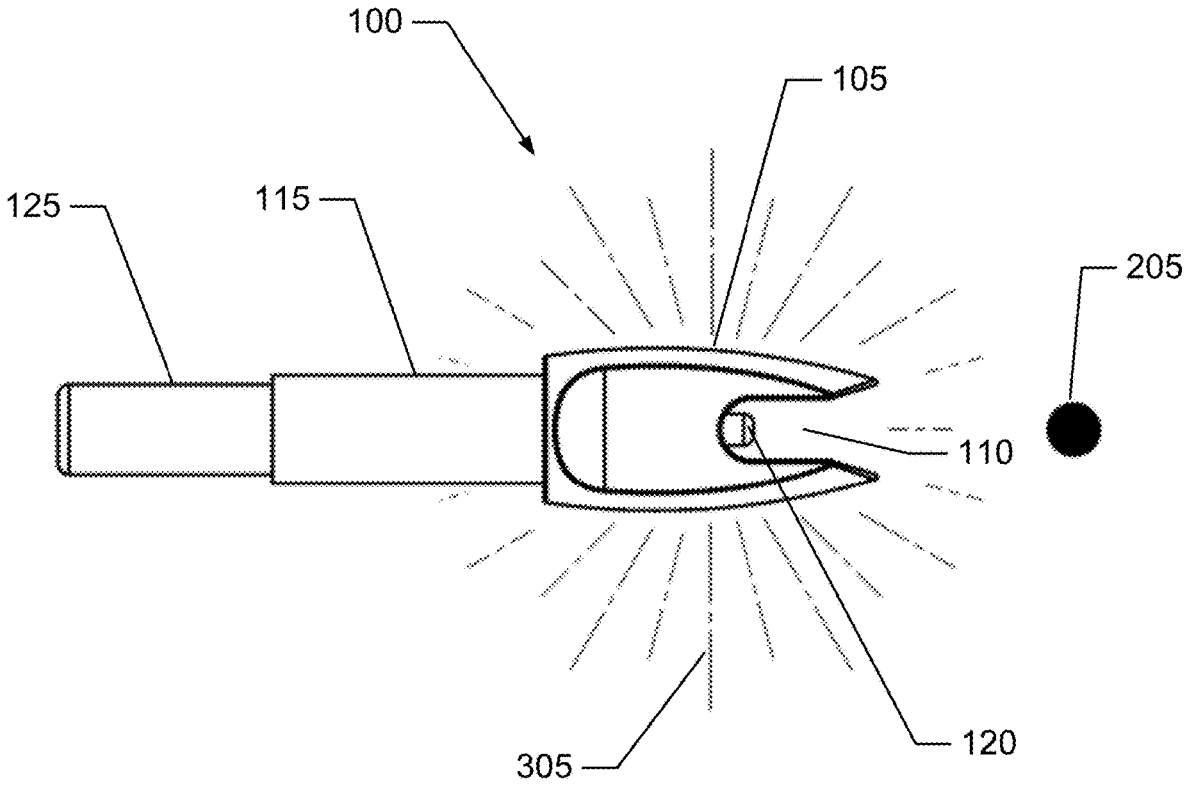
FIG. 3 is a top perspective of a lighted nock device in the "On" illuminated state, in accordance with some embodiments.

FIG. 3 is a top perspective of a lighted nock device in the "On" illuminated state, in accordance with some embodiments.

In some embodiments, the lighted nock device 100 comprises the nock body 105 having a slot 110 for attaching to the bowstring 205, an arrow or shaft attachment portion 115, a push member 120 located at least partially within nock body 105, and a power source 125. After withdrawal of the bowstring 205 from the bottom of the slot 110, the switch closes and the luminous assembly is activated, i.e. turned on. The light 305 emitted from the luminous assembly passes through the translucent nock body and also the push member if made from a translucent material. A portion of the push member 120 still passes through the opening in the nock body 105 and into the bottom of the slot 110 to allow for the turning off of the luminous assembly. The luminous assembly remains on during and after the flight of the arrow until the user desires to turn off the luminous assembly by simply depressing and releasing push member 120 again with any slender object of their choosing or even the bowstring. If an object is used to turn off the luminous assembly, the lighted nock device is ready to be attached to a bowstring and shot again. If the bowstring is used to turn off the luminous assembly, the nock has to be removed from the bowstring and then would be ready to be attached to a bowstring and shot again.

Figure 4:
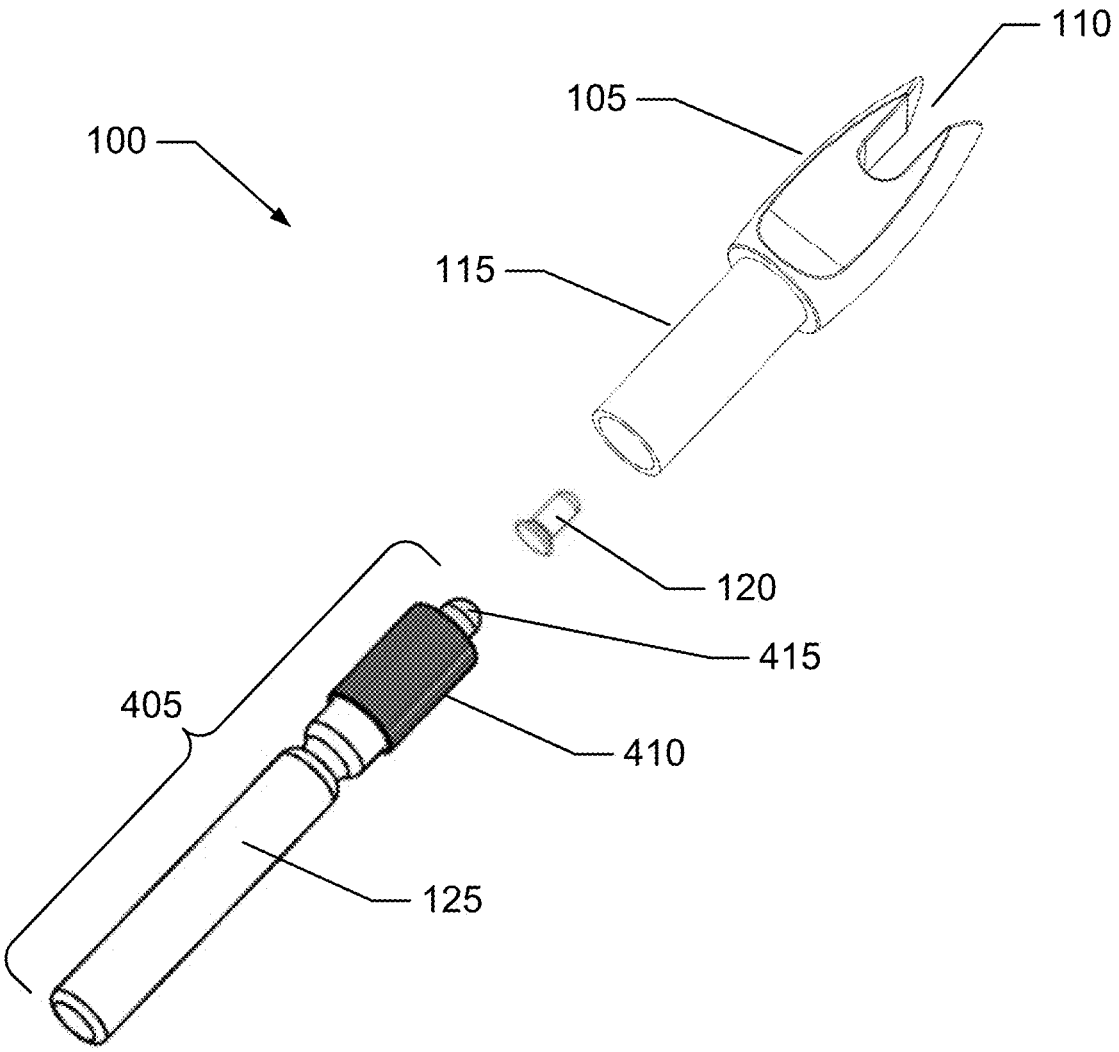
FIG. 4 is an exploded side perspective of a lighted nock device, in accordance with some embodiments.

FIG. 4 is an exploded side perspective of a lighted nock device, in accordance with some embodiments.

In some embodiments, the lighted nock device 100 comprises a nock body 105, a slot 110 for attaching to a bowstring, a portion 115 for attaching to an arrow or shaft, a push member 120, and a luminous assembly 405. The luminous assembly 405 comprises a power source 125, a switch 410, and a light source 415. The internal workings of some embodiments of the switch 410 are illustrated in FIG. 6A, FIG. 6B, FIG. 6C, FIG. 7A, FIG. 7B, FIG. 7C, FIG. 8A, FIG. 8B, FIG. 8C, FIG. 9A, and FIG. 9B. When fully assembled, a portion of the push member 120 will protrude through the nock body 105 when the luminous assembly 405 is either off or on as shown in FIG. 1 and FIG. 3, respectively. When the luminous assembly is on, the switch is in the closed position and when the luminous assembly is off, the switch is in the open position. A portion of the push member 120 will protrude through the nock body 105 except when attached to a bowstring as shown in FIG. 2. The switch 410 of the luminous assembly 405 comprises a mechanism which allows for a portion of the push member 120 to protrude through the nock body in both the light source on and light source off states. The luminous assembly 405 may be toggled on and off by pressing down and releasing, directly or indirectly, on the light source 415 to act on the switch 410.

In some embodiments, as illustrated in FIG. 6A, FIG. 6C, FIG. 8A, and FIG. 8C, the light source has two resting positions relative to the power source. In one embodiment, when the light source is positioned closest to the power source, the electrical circuit between the light source and the battery does not close and the luminous assembly is in the off state and when the light source is positioned furthest from the power source, the electrical circuit between the light source and the battery does close and the luminous assembly is in the on state. In an alternative embodiment, when the light source is positioned closest to the power source, the electrical circuit between the light source and the battery does close and the luminous assembly is in the on state and when the light source is positioned furthest from the power source, the electrical circuit between the light source and the battery does not close and the luminous assembly is in the off state.

In some embodiments, as illustrated in FIG. 7A and FIG. 7C, the light source is rotationally indexed about the center axis of the power source. In this embodiment, when the light source is depressed towards the power source and subsequently released, the light source is rotated to an index position to either turn on or off the luminous assembly depending on if the luminous assembly had been off or on, respectively.

In yet other embodiments, as illustrated in FIG. 9A and FIG. 9B, the light source stays fixed relative to the power source. In this embodiment, a switch is directly acted on to operatively connect the light source and the power source.

In some embodiments, the luminous assembly illustrated and described in FIG. 1, FIG. 2, FIG. 3, FIG. 4, FIG. 5, FIG. 6A, FIG. 6B, FIG. 6C, FIG. 7A, FIG. 7B, FIG. 7C, FIG. 8A, FIG. 8B, FIG. 8C, FIG. 9A, FIG. 9B, and FIG. 10 may comprise a light source which strobes on and off or strobes between different colors when activated. Additionally, the strobing of the light source may be configured such that the strobing does not commence until after a delay, such as a few seconds, has elapsed after the activation of the luminous assembly. This delay in the illumination of the strobing allows for an easier tracking of the arrow during flight and a facilitated location during recovery of the arrow.

Although the functionality of light source 415 may, in some exemplary embodiments, be provided by an LED, those skilled in the art will realize that light sources other than LEDs may also be used. Accordingly, the concepts, systems, and techniques described herein are not limited to any particular type of light source.

Although the nock body 105 may, in some exemplary embodiments, be provided by a nock body adapted for use with a bow, those skilled in the art will realize that a nock body adapted for use with a crossbow may also be used.

In an alternate embodiment, the luminous assembly 405 can be reversed or arranged in a different order so that a component other than the push member makes contact with the bowstring when the arrow is nocked. For example, but not by way of limitation, a portion of the light source could protrude into the slot. Furthermore, all or parts of the luminous assembly may be located anywhere within the arrow or the nock body, as long as the receiving and withdrawal of the bowstring from the bottom of the slot (or any other user selected object that fits into the bottom of the slot) causes the switch to toggle between open and closed.

Figure 5:
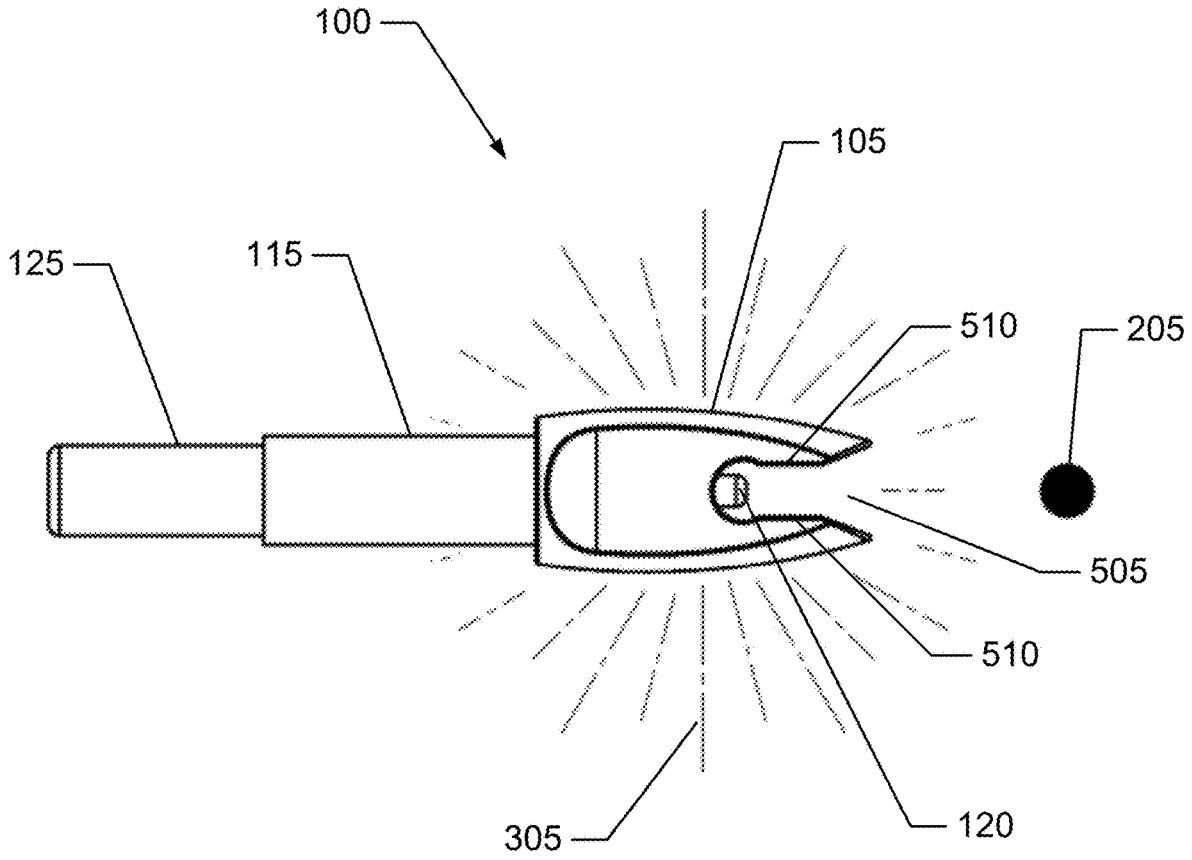
FIG. 5 is a top perspective of a lighted nock device in the "On" illuminated state, in accordance with some embodiments.

FIG. 5 is a top perspective of a lighted nock device in the "On" illuminated state, in accordance with some embodiments.

In some embodiments, the lighted nock device 100 comprises the nock body 105 having a slot 505 for attaching to the bowstring 205, an arrow or shaft attachment portion 115, a push member 120 located at least partially within nock body 105, and a power source 125. In this embodiment, the slot 505 comprises a middle portion 510 configured to retain the bowstring 205 in the bottom of the slot 505 when the arrow is nocked onto the bowstring, i.e. the bottom of the slot has received a bowstring. After withdrawal of the bowstring 205 from the bottom of the slot 505, the switch closes and the luminous assembly is activated. The light 305 emitted from the luminous assembly passes through the translucent nock body and also the push member if made from a translucent material. A portion of the push member 120 still passes through the opening in the nock body 105 and into the bottom of the slot 505 to allow for the turning off of the luminous assembly. The luminous assembly remains on during and after the flight of the arrow until the user desires to turn off the luminous assembly by simply depressing and releasing push member 120 again with any slender object of their choosing or even the bowstring. If an object is used to turn off the luminous assembly, the lighted nock device is ready to be attached to a bowstring and shot again. If the bowstring is used to turn off the luminous assembly, the nock has to be removed from the bowstring and then would be ready to be attached to a bowstring and shot again.

FIG. 6A, FIG. 6B, and FIG. 6C are side perspectives of a luminous assembly in the on, depressed, and off states, respectively, in accordance with some embodiments.

In some embodiments, the luminous assembly 405 comprises a switch body (not shown), a power source 125 at least partially disposed within the switch body, a switch 600 at least partially disposed within the switch body, and a light source 415 at least partially disposed within the switch body. The switch body is not shown in FIG. 6A, FIG. 6B, and FIG. 6C in order to illustrate the inner workings of the luminous assembly. In some embodiments, the nock body 105 may serve as the switch body for the luminous assembly. The power source 125 comprises a pin type lithium battery such as the Panasonic BR425. The switch 600 comprises a spring 605, a movable retaining arm 610, and a guiding body 615. The spring 605 is connected to the central negative post of the power source 125 and provides electrical continuity to the cathode of the light source 415 as well as resistance against the depressing of the light source 415. In some embodiments where the spring 605 is non-conducting, a separate conducting member is used to make contact between the negative post of the power source and the cathode of the light source. A conducting element 620 is used to make electrical contact between the positive case of the power source 125 and the anode of the light source 415 when the switch is toggled to the closed luminous assembly on state as illustrated in FIG. 6A. In this luminous assembly on state, the spring 605 pushes the guiding body 615 away from the power source 125 and forces the end tip of the movable retaining arm 610 against a first retaining member 625 of the guiding body 615, thus positioning the guiding body 615 such that the anode of the light source 415 makes contact with the conducting element 620. In some embodiments, the first retaining member 625 comprises a v-shaped well. When the light source 415 is depressed towards the power source 125, the spring 605 is further compressed and the end tip of the movable retaining arm 610 is guided by the backside of a second retaining member 630 and the walls of the guiding body 615 to a first depressed position 635 as illustrated in FIG. 6B. Next, when the light source 415 is released, the end tip of the movable retaining arm 610 is guided to the retaining side of the second retaining member 630. When the end tip of the movable retaining arm 610 is resting against the second retaining member 630, the anode of the light source 415 is physically separated from the conducting element 620 and the luminous assembly 405 is placed into the off state as illustrated in FIG. 6C.

In an alternative embodiment, the luminous assembly 405 may be placed into the on state by sizing and positioning the conducting element 620 to make contact between the positive case of the power source 125 and the anode of the light source 415 when the end tip of the movable retaining arm 610 is resting against the second retaining member 630 instead of the first retaining member 625. In this alternate embodiment, the luminous assembly 405 would be in the off state when the end tip of the movable retaining arm 610 is resting against the first retaining member 625.

In an alternate embodiment, the luminous assembly 405 can be reversed or arranged in a different order so that a component other than the light source makes contact with the push member or bowstring when the arrow is nocked. For example, but not by way of limitation, a portion of the light source could protrude into the slot. Furthermore, all or parts of the luminous assembly may be located anywhere within the arrow or the nock body, as long as the receiving and withdrawal of the bowstring from the bottom of the slot (or any other user selected object that fits into the bottom of the slot) causes the switch to toggle.

FIG. 7A, FIG. 7B, and FIG. 7C are side perspectives of a luminous assembly in the on, depressed, and off states, respectively, in accordance with some embodiments.

In some embodiments, the luminous assembly 405 comprises a switch body (not shown), a power source 125 at least partially disposed within the switch body, a switch 700 at least partially disposed within the switch body, and a light source 415 at least partially disposed within the switch body. The switch body is not shown in FIG. 7A, FIG. 7B, and FIG. 7C in order to illustrate the inner workings of the luminous assembly. In some embodiments, the nock body 105 may serve as the switch body for the luminous assembly. In the embodiments illustrated in FIG. 7A, FIG. 7B, and FIG. 7C, the light source 415 is configured such that a push member is not required since a portion of the light source would protrude through the nock body when the light source is either in the off or on states. The power source 125 comprises a pin type lithium battery such as the Panasonic BR425. The switch 700 comprises a spring 705, a first fixed guiding body 710, a second fixed guiding body 715, and a rotating indexing body 720. The second fixed guiding body 715 may be attached to either the switch body of the luminous assembly or into the nock body 105 (shown in FIGS. 1-5) in the embodiments where the nock body also at least partially houses the luminous assembly. The first fixed guiding body 710 complements the first guiding surface 725 of the rotating indexing body 720 and the second fixed guiding body 715 complements the second guiding surface 730 of the rotating indexing body 720. The spring 705 is connected to the central negative post of the power source 125 and provides electrical continuity to the cathode of the light source 415 as well as resistance against the depressing of the light source 415. In some embodiments where the spring 705 is non-conducting, a separate conducting member is used to make contact between the negative post of the power source and the cathode of the light source. One or more conducting elements 735 are used to make electrical contact between the positive case of the power source 125 and the electrical contact pad 740 of the anode of the light source 415 when the switch is indexed to the closed luminous assembly on state as illustrated in FIG. 7A. In this embodiment, when the light source 415 is depressed towards the power source 125, the rotating indexing body 720 is guided and rotated by the first fixed guiding body 710 as illustrated in FIG. 7B. When the light source 415 is subsequently released, the spring 705 pushes the rotating indexing body 720 against the second fixed guiding body 715 which in turn guides and rotates the rotating indexing body 720 to the next indexed position, placing the luminous assembly into the off state as illustrated in FIG. 7C. The index positions of the rotating indexing body 720 alternate between the closed luminous assembly on state and the open luminous assembly off state. In an alternative embodiment, the first fixed guiding body 710 and/or the second fixed guiding body 715 are replaced with fixed guiding pins which are used to guide and rotate the rotating indexing body 720.

In some embodiments, the rotating index body 720 and the light source 415 are not only coupled together but are integrated into a single piece. In such an embodiment, the light source will be shaped with first and second guiding surfaces, similar to those of the rotating index body 720, which will allow for the guiding and rotating of the light source to the on and off index positions.

In an alternate embodiment, the luminous assembly 405 can be reversed or arranged in a different order so that a component other than the light source makes contact with the bowstring when the arrow is nocked. For example, but not by way of limitation, a portion of the light source could be placed within or behind the first fixed guiding body and a separate push member could be used to protrude into the slot. Furthermore, all or parts of the luminous assembly may be located anywhere within the arrow or the nock body, as long as the receiving and withdrawal of the bowstring from the bottom of the slot (or any other user selected object that fits into the bottom of the slot) causes the switch to toggle.

FIG. 8A, FIG. 8B, and FIG. 8C are side perspectives of a luminous assembly in the on, depressed, and off states, respectively, in accordance with some embodiments.

In some embodiments, the luminous assembly 405 comprises a switch body (not shown), a power source 125 at least partially disposed within the switch body, a switch 800 at least partially disposed within the switch body, and a light source 415 at least partially disposed within the switch body. The switch body is not shown in FIG. 8A, FIG. 8B, and FIG. 8C in order to illustrate the inner workings of the luminous assembly. In some embodiments, the nock body 105 may serve as the switch body for the luminous assembly. A push member 805 is shown over the light source 415 and is used to depress and release the light source 415 as well as guide the light from the light source. In this embodiment, the push member 805 protrudes through the body when the light source is either in the off or on states. The power source 125 comprises a pin type lithium battery such as the Panasonic BR425. The switch 800 comprises a first spring 810, a rotating ratchet 815, a rotating ratchet spring 820, a sliding ratchet 825, a sliding ratchet spring 830, and guide members 835. The guide members 835 may be attached or integrated to either the switch body for the luminous assembly or into the nock body 105 (shown in FIGS. 1-5) in the embodiments where the nock body also at least partially houses the luminous assembly. The first spring 810 is connected to the central negative post of the power source 125 and provides electrical continuity to the cathode of the light source 415 as well as resistance against the depressing of the light source 415. In some embodiments where the first spring 810 is non-conducting, a separate conducting member is used to make contact between the negative post of the power source and the cathode of the light source. A conducting element 840 is used to make electrical contact between the positive case of the power source 125 and the anode of the light source 415 when the switch is placed into the closed luminous assembly on state as illustrated in FIG. 8A. In this embodiment, when the push member 805 is depressed towards the power source 125, the sliding ratchet 825 is pressed down against the rotating ratchet 815 which in turn also moves the rotating ratchet 815 toward the power source 125 and further compresses the rotating ratchet spring 820 until the point where the teeth of the sliding ratchet 825 are aligned with the guide members 835. At this point, the force from the rotating ratchet spring 820 will cause the rotating ratchet 815 to rotate as the teeth of the rotating ratchet 815 slide along the teeth of the guide members 835 as illustrated in FIG. 8B and ultimately the rotating ratchet 815 comes to rest against the guide members 835. When the rotating ratchet 815 is resting against the guide members 835, no force from the rotating ratchet spring 820 is being transferred to the to the sliding ratchet 825 and no contact will be made between the conducting element 840 and the anode of the light source 415, thus placing the switch into the open luminous assembly off state as illustrated in FIG. 8C. The sliding ratchet spring 830 ensures that the anode of the light source 415 does not inadvertently make contact with conducting element 840.

In an alternate embodiment, the luminous assembly 405 can be reversed or arranged in a different order. For example, but not by way of limitation, a portion of the light source could be placed within or behind the rotating ratchet. Furthermore, all or parts of the luminous assembly may be located anywhere within the arrow or the nock body, as long as the receiving and withdrawal of the bowstring from the bottom of the slot (or any other user selected object that fits into the bottom of the slot) causes the switch to toggle.

FIG. 9A and FIG. 9B are side perspectives of a luminous assembly in the on and off states, respectively, in accordance with some embodiments.

In some embodiments, the luminous assembly 405 comprises a switch body (not shown), a power source 125 at least partially disposed within the switch body, and a printed circuit board (PCB) 905 at least partially disposed within the switch body and having a logic device 910, such as a microcontroller, a switch 915, and a light source 920. Electrical continuity between the positive case of the power source 125 and the positive input of the PCB 905 is made with conducting element 925 and electrical continuity between the central negative post of the power source 125 and the negative input of the PCB 905 is made with conducting element 930. The switch body is not shown in FIG. 9A and FIG. 9B in order to illustrate the inner components of the luminous assembly. In some embodiments, the nock body 105 may serve as the switch body for the luminous assembly. The power source 125 comprises a pin type lithium battery such as the Panasonic BR425. In some embodiments, a portion of the switch 915 may protrude through the switch body. Alternatively, a push member may be used to push onto the switch 915 and thus the push member would protrude through the switch body. In some embodiments, when the light source 920 is in the off state, as illustrated in FIG. 9B, and the switch is directly or indirectly depressed, the logic device 910 will be programmed to keep the light source 920 in the off state. As soon as the switch 915 is released, the logic device 910 will be programmed to turn the light source 920 on, as illustrated in FIG. 9A. The logic device 910 may further be programmed to turn the light source 920 back off by depressing and releasing the switch 920 again. In this embodiment, the logic device 910 may additionally be programmed to flash the light source 920 on and off either immediately or after a certain amount of time after initial illumination. This feature would enable the conservation of the energy of the power source 125. The logic device 910 may also be used to control the color of the light source 920 in embodiments where the light source 920 comprises two or more light sources, such as in a color changing LED.

In some embodiments, the PCB board does not have a logic device. In this embodiment, the switch directly operatively connects the light source and the power source and would be capable of toggling the light source on and off by the depressing and releasing of the switch. Further, if the switch comprises a selector-type switch, then for an embodiment with two or more light sources, power can be cycled between the two or more light sources. For example, with an RGB LED light source, power can first be applied to the red LED to illuminate it and when the switch is depressed and released, twice, power is removed from the red LED and applied to the green LED, thus illuminating only the green LED. This same process would be repeated to power and illuminate the blue LED.

In some embodiments, the luminous assemblies illustrated and described in FIG. 6A, FIG. 6B, FIG. 6C, FIG. 7A, FIG. 7B, FIG. 7C, FIG. 8A, FIG. 8B, FIG. 8C, FIG. 9A, and FIG. 9B may be used in other sports and entertainment products such as for badminton shuttlecocks, fishing bobs and lures, flying discs, boomerangs, golf balls, and the like.

FIG. 10 is an exploded side perspective of a lighted bolt end device, in accordance with some embodiments.

In some embodiments, the lighted nock device may be configured for use on a crossbow. In such an embodiment, the lighted bolt end device 1000 comprises a bolt end body 1005, a portion 1010 for attaching to a bolt or shaft, a push member 1015, and a luminous assembly 1020. The luminous assembly 1020 comprises a power source 1025, a switch 1030, and a light source 1035. The internal workings of some embodiments of the switch 1030 are illustrated in FIG. 6A, FIG. 6B, FIG. 6C, FIG. 7A, FIG. 7B, FIG. 7C, FIG. 8A, FIG. 8B, FIG. 8C, FIG. 9A, and FIG. 9B. When fully assembled and in the open position (luminous assembly turned off), a portion of the push member 1015 passes through an opening 1040 on the face of the bolt end body 1005 opposite the portion 1010 for attaching to a bolt or shaft. A portion of the push member 1015 will protrude through the bolt end body 1005 except when the bolt end body abuts against a bowstring or other object. The switch 1030 of the luminous assembly 1020 comprises a mechanism which allows for a portion of the push member 1015 to protrude through the face of the bolt end body in both the light source on and light source off states. The luminous assembly 1020 may be toggled on and off by pressing down and releasing, directly or indirectly, on the light source 1035 to act on the switch 1030. In some embodiments, the luminous assembly 1020 may be toggled on and off by pressing down and releasing on the push member 1015 to act on the light source 1035 which in turn acts on the switch 1030. In some embodiments, there is no push member 1015 and the light source 1035 is shaped similar to the light source illustrated in FIG. 7A, FIG. 7B, and FIG. 7C and thus the luminous assembly 1020 may be toggled on and off by directly pressing down and releasing on the light source 1035 to act on the switch 1030.

In some embodiments, the bolt or shaft attachment portion 1010 is configured to be inserted into an adapter having an inner diameter configured to mate with the outer diameter of the bolt or shaft attachment portion 1010. The adapter has an outer diameter larger than the outer diameter of the bolt or shaft attachment portion 1010 and is configured to be used as a bushing between the lighted bolt end device 1000 and a bolt with a larger diameter than the bolt or shaft attachment portion 1010.

In an alternate embodiment, the luminous assembly 1020 can be reversed or arranged in a different order so that a component other than the push member makes contact with the bowstring when the push member is pressed down. For example, but not by way of limitation, a portion of the light source could protrude through the opening on the face of the bolt end body. Furthermore, all or parts of the luminous assembly may be located anywhere within the bolt or the bolt end body, as long as the abutting and separation of the bowstring from the push member or light source (or any other user selected object) causes the switch to toggle between open and closed.

FIG. 11 is a flowchart illustrating a method for using a lighted nock device, in accordance with some embodiments.

According to one embodiment of the present invention, the method begins at block 1105, where, with the lighted nock device attached to an arrow and the luminous assembly turned off, the lighted nock device is attached to a bowstring, i.e. the slot of the lighted nock device receives the bowstring, in order to depress the push member or light source. At block 1110, the bow is drawn and the bowstring is released, ultimately resulting in the withdrawal of the bowstring from the bottom of the slot, the closing of the switch of the lighted nock, and the turning on of the luminous assembly. The archer can now see the light emitted from the lighted nock device allowing the archer to be able to more easily see the arrow during flight, see the point of arrow impact, and recover the arrow after the shot. The switch is maintained in the closed position (light source activated) until the archer desires to turn off the light source. After the arrow has been recovered, at block 1115, the lighted nock device may be turned off by depressing and releasing the push member or light source with any object, even the bowstring. The archer can now reuse the lighted nock device.

FIG. 12 is a flowchart illustrating a method for using a lighted bolt end device, in accordance with some embodiments.

According to one embodiment of the present invention, the method begins at block 1205, where a bowstring of a crossbow is cocked. At block 1210, with a lighted bolt end device attached to a bolt and the luminous assembly turned off, the lighted bolt end device is loaded into the barrel of the crossbow and pressed against the bowstring in order to depress the push member or light source of the lighted bolt end device. At block 1215, the crossbow is fired to release the bowstring, ultimately resulting in the separation of the lighted bolt end device from the bowstring and the releasing of the push member or light source and the turning on of the luminous assembly. The archer can now see the light emitted from the lighted bolt end device allowing the archer to be able to more easily see the bolt during flight, see the point of bolt impact, and recover the bolt after the shot. The switch is maintained in the closed position (light source activated) until the archer desires to turn off the light source. After the bolt has been recovered, at block 1220, the lighted bolt end device may be turned off by depressing and releasing the push member or light source with any object, even the bowstring. The archer can now reuse the lighted bolt end device.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions, and improvements to the embodiments described above are possible. It is contemplated that these variations, modifications, additions, and improvements fall within the scope of the invention as detailed within the following claims.

The invention claimed is:

1. A lighted nock comprising:

a nock body comprising:

an arrow or shaft attachment portion; and a slot adapted to receive a bowstring; and a luminous assembly at least partially disposed within the nock body, wherein the luminous assembly comprises a power source, a light source, and a switch;

wherein when the luminous assembly is off, the luminous assembly is configured to be activated by an initial depressing of the light source which does not turn on the luminous assembly and a subsequent releasing of the light source which turns on the luminous assembly, and wherein when the luminous assembly is on, the luminous assembly is configured to be deactivated by depressing of the light source and subsequent releasing of the light source which turns off the luminous assembly.

2. The lighted nock of claim 1, wherein at least a portion of the light source protrudes through and into the slot when the luminous assembly is in either an activated or deactivated state.

3. The lighted nock of claim 1, wherein the slot comprises:

a bottom; and a middle portion;

wherein the bottom is adapted to receive the bowstring and wherein the middle portion is configured to retain the bowstring in the bottom of the slot.

4. The lighted nock of claim 1, further comprising an adapter comprising an inner diameter and an outer diameter, wherein the inner diameter is configured to mate with the arrow or shaft attachment portion of the nock body and wherein the outer diameter is configured to mate with an arrow or shaft.

5. The lighted nock of claim 1, wherein the light source is strobed.

6. A luminous assembly comprising:

a body;

a power source at least partially disposed within the body;

a light source at least partially disposed within the body and wherein at least a portion of the light source protrudes through the body; and a switch at least partially disposed within the body;

wherein the switch operatively connects the light source and the power source; and wherein when the luminous assembly is off, the luminous assembly is configured to be activated by an initial depressing of the light source which does not turn on the luminous assembly and a subsequent releasing of the light source which turns on the luminous assembly, and wherein when the luminous assembly is on, the luminous assembly is configured to be deactivated by depressing of the light source and subsequent releasing of the light source which turns off the luminous assembly.

7. The lighted nock of claim 6, wherein the light source is strobed.

8. The luminous assembly of claim 6, wherein the body comprises a nock and wherein the nock comprises an arrow or shaft attachment portion and a slot adapted to receive a bowstring.

9. The luminous assembly of claim 8, wherein the luminous assembly is activated when the bowstring is withdrawn from the slot and the switch is closed.

10. The luminous assembly of claim 8, wherein at least a portion of the light source protrudes through and into the slot when the luminous assembly is in either an activated or deactivated state.

11. The luminous assembly of claim 8, wherein the slot comprises:

a bottom; and a middle portion;

wherein the bottom is adapted to receive the bowstring and wherein the middle portion is configured to retain the bowstring in the bottom of the slot.

12. The luminous assembly of claim 8, further comprising an adapter comprising an inner diameter and an outer diameter, wherein the inner diameter is configured to mate with the arrow or shaft attachment portion of the nock and wherein the outer diameter is configured to mate with an arrow or shaft.

13. The luminous assembly of claim 6, wherein the body comprises a bolt end and wherein the bolt end comprises a bolt or shaft attachment portion and a proximate end adapted to abut against a bowstring.

14. The luminous assembly of claim 13, wherein the luminous assembly is activated when the bolt end is separated from the bowstring and the switch is closed.

15. The luminous assembly of claim 13, wherein at least a portion of the light source protrudes through the proximate end when the luminous assembly is in either an activated or deactivated state.

16. The luminous assembly of claim 13, further comprising an adapter comprising an inner diameter and an outer diameter, wherein the inner diameter is configured to mate with the bolt or shaft attachment portion of the bolt end and wherein the outer diameter is configured to mate with a bolt or shaft.

17. A method for illuminating a nock, comprising:

providing a nock having: a nock body comprising: an arrow or shaft attachment portion;

and a slot adapted to receive a bowstring; and a luminous assembly at least partially disposed within the nock body, wherein the luminous assembly comprises a power source, a light source, and a switch; wherein when the luminous assembly is off, the luminous assembly is configured to be activated by an initial depressing of the light source which does not turn on the luminous assembly and a subsequent releasing of the light source which turns on the luminous assembly, and wherein when the luminous assembly is on, the luminous assembly is configured to be deactivated by depressing of the light source and subsequent releasing of the light source which turns off the luminous assembly;

drawing the bowstring; and releasing the bowstring, thereby withdrawing the bowstring from the slot and illuminating the nock.

18. The method of claim 17, wherein the light source is strobed.

19. A method for illuminating a bolt end, comprising:

providing a bolt end having: a bolt end body comprising: a bolt or shaft attachment portion; and a proximate end adapted to abut against a bowstring; and a luminous assembly at least partially disposed within the bolt end body, wherein the luminous assembly comprises a power source, a light source, and a switch; wherein when the luminous assembly is off, the luminous assembly is configured to be activated by an initial depressing of the light source which does not turn on the luminous assembly and a subsequent releasing of the light source which turns on the luminous assembly, and wherein when the luminous assembly is on, the luminous assembly is configured to be deactivated by depressing of the light source and subsequent releasing of the light source which turns off the luminous assembly;

drawing the bowstring; and releasing the bowstring, thereby separating the bolt end from the bowstring and illuminating the bolt end.

* * * * *